US006742881B2

(12) United States Patent
Kotaki et al.

(10) Patent No.: US 6,742,881 B2
(45) Date of Patent: Jun. 1, 2004

(54) INK CONTAINER

(75) Inventors: Yasuo Kotaki, Kanagawa-ken (JP); Kenta Udagawa, Kanagawa-ken (JP); Shuzo Iwanaga, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 63 days.

(21) Appl. No.: 10/202,913

(22) Filed: Jul. 26, 2002

(65) Prior Publication Data

US 2003/0020790 A1 Jan. 30, 2003

(30) Foreign Application Priority Data

Jul. 27, 2001 (JP) ..... 2001/227737
Jul. 10, 2002 (JP) ..... 2002/201626

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | | | |
|---|---|---|---|---|---|
| 5,233,369 | A | * | 8/1993 | Carlotta et al. | 347/87 |
| 5,621,446 | A | * | 4/1997 | Tanaka et al. | 347/85 |
| 5,790,157 | A | * | 8/1998 | Higuma et al. | 347/85 |
| 6,247,803 | B1 | | 6/2001 | Kanaya et al. | 347/86 |
| 6,422,692 | B2 | | 7/2002 | Yamazaki et al. | 347/86 |
| 2001/0026306 | A1 | | 10/2001 | Yamazaki et al | 347/86 |

FOREIGN PATENT DOCUMENTS

| | | | | |
|---|---|---|---|---|
| DE | 196 15 925 | | 10/1996 | |
| EP | 488829 | | 6/1992 | |
| EP | 542247 | | 5/1993 | |
| FR | 2229320 | | 12/1974 | |
| JP | 06-015841 A | * | 1/1994 | 347/85 |
| JP | 2000-334973 | | 12/2000 | |
| JP | 2001-30513 | | 2/2001 | |
| JP | 2001-260377 | | 9/2001 | |
| JP | 2001-260378 | | 9/2001 | |
| JP | 2001-260379 | | 9/2001 | |

* cited by examiner

*Primary Examiner*—Anh T. N. Vo
(74) *Attorney, Agent, or Firm*—Fitzpatrick, Cella, Harper & Scinto

(57) ABSTRACT

An ink container comprising a negative pressure generating member accommodating portion for accommodating a negative pressure generating member for retaining therein pigment ink to be supplied to an ink jet head; an ink supply port for supplying the ink to the ink jet head; an air vent for fluid communication between the negative pressure generating member accommodating portion and an ambient air; and an ink non-transmitting portion for partly blocking flow of the ink in the negative pressure generating member toward the ink supply port, wherein fluid communication is enabled except for the non-transmitting portion, and a sectional area, across a general direction of the flow of the ink toward the ink supply port in the negative pressure generating member accommodating portion, of non-communicating portion is not less than 50%.

14 Claims, 18 Drawing Sheets

(a)

(b)

(a)

(b)

(a)

(b)

(a)

(b)

(a)

(b)

(a)

(b)

INK CONTAINER

FIELD OF THE INVENTION AND RELATED ART

The present invention related to an ink container containing an absorbent member for holding the ink to be supplied to an ink jet head employed by an ink jet printer, or the like. In particular, it relates to an ink container improved to make it possible to satisfactorily use pigment-based ink.

An ink container for supplying an inkjet head with ink is structured so that the ink holding force of an ink holding member disposed in the ink container is used for generating the ink supplying pressure necessary for the ink ejection characteristic of an inkjet head, or that the pressure generated by the pressure head difference between the position of the ink surface in the ink container and the position of the ejection orifice of an inkjet head is used as the pressure for supplying ink through an ink supplying tube.

In recent years, a personal computer has come to be widely used, and with the widespread usage of a personal computer, a printer has come to be widely used. There is a call for reducing printer size, and therefore, a large number of printers employ an ink container having the former of the above described structures, in which the ink holding force of the ink holding member is utilized. As for the material for the ink holding member placed in an ink container, generally, foamed polyurethane or PP fibers are employed in consideration of ink holding member cost, and of the state of contact between the ink holding member and ink. Numerous microscopic holes or microscopic gaps in these materials generate capillary force, which functions as ink holding force. In consideration of color development, ejection stability, countermeasure for the problem that while an ink container is left unused for a long period of time, the ink in the portion of the ink absorbent member adjacent to the ink outlet dries and solidifies, and the like, dyestuff-based ink has long been used as the ink to be filled into an ink holding member structured as described above.

In recent years, even a print produced by an inkjet has begun be required to match a print produced by a laser beam printer (LBP) in terms of print density, color development, and/or resistance to ambient elements. In particular, it is desired that black ink is improved in terms of the optical density of a print produced by recording letters on ordinary recording paper.

When using an ink employing dyestuff as coloring agent, it is difficult to improve the above described optical density, because of the characteristics of dyestuff. Further, an ink employing dyestuff as coloring agent has not been improved enough to be satisfactory in terms of waterproofing and light-proofing. Thus, in order to solve the above described problems of dyestuff-based ink, it has been proposed to use recording paper dedicated for inkjet recording, more specifically, ordinary recording paper provided with an ink catching layer (coated paper). However, such recording paper is most costly than ordinary recording paper. Therefore, there has been demand for a method for improving image quality while using inexpensive ordinary recording paper.

There are some methods for effecting a high level of image quality on the surface of recording paper, in which ink density is improved by ejecting ink processing agent at the same time as ink is ejected. However, employment of any of such methods increases the size of a recording apparatus itself, and also, the cost of the ink processing agent adds to the overall cost. Thus, usage of a recording apparatus employing such a method has been limited to special jobs.

Thus, it has been proposed to use pigment as the coloring agent for ink. When pigment is used as the coloring agent for ink, it is relatively easy to increase the optical density because of the pigment properties. Further, pigment is superior in waterproofness to dyestuff. Therefore, the number of opportunities for using pigment as the coloring agent for black ink for a recording apparatus used mainly for outputting documents or the like, has been increasing.

Further, recently, the choice of coloring agent seems to be shifting from dyestuff to pigment, even in the field of color ink.

In the case of pigment-based ink, there are problems which will be described next: When the ink in an ink container is such ink that contains pigment as a coloring agent, and liquid medium in which the pigment is dispersed, and the ink container is left undisturbed for a long period of time, pigment settles, because pigment is greater in molecular weight than dyestuff or the like, being therefore affected by gravity. As a result, the coloring agent concentration within the ink container becomes nonuniform. Here, settle means the phenomenon that microscopic particles are caused to sink by gravity. Provided that microscopic particles do not agglomerate, the rate at which microscopic particles settle is determined by the relation between the speed at which the particles settle in the gravity direction, and which can be obtained by Stokes equation given below, and the Brownian movement of the particles.

Stokes' equation:

$$Vs=2a(\rho-\rho 0)g/9\eta \tag{1}$$

Vs: setting speed a: particle radius

ρ: particle concentration

ρ0: solvent g: gravitational acceleration

η: solvent viscosity

Brownian movement:

$$X=(Rtt/3\pi NA\rho a) \tag{2}$$

X: average distance particles move in time t

R: gas constant

T: absolute temperature

NA: Avogadro s number

η: solvent viscosity a: particle radius

The microscopic particles settle when the setting speed obtained by the Stokes equation given above overwhelms the dispersion resulting from the Brownian movement.

Further, an ink container is provided with an air vent for connecting the internal space of the ink container to the atmospheric air; allowing the evaporative components in the ink in the ink container to evaporate through the air vent. Therefore, as time goes by, the coloring agent concentration increases, adding to the nonuniformity of the coloring agent concentration in the ink container. In particular, when an air vent is in a surface other than the surface opposing the surface in which the ink outlet is present, the increase in the coloring agent concentration in the adjacencies of the ink outlet caused by the coloring agent settlement and ink component evaporation are more apparent.

In the case of an ink container in which pigment-based ink is directly held in a pouch-like internal container, without being absorbed in an absorbent member or the like, and in which negative pressure is generated using a leaf spring or the like, the pigment in the pouch-like internal container can be easily stirred by utilizing the scanning movement of the carriage resulting from a recording operation. Therefore, the above described pigment settlement does not become a serious problem.

However, in the case of an ink container, the entire internal space of which is filled with absorbent material such as foamed polyurethane, PP fibers, or the like, the ink holding force of the absorbent material substantially suppresses the pigment dispersion. Therefore, the pigment distribution in the absorbent material becomes nonuniform while the ink container is left undisturbed. In the case of this type of an ink container, once the pigment distribution becomes nonuniform, it is virtually impossible to instantly re-disperse the coloring agent. For example, if an ink container is left unused, being mounted in an inkjet recording apparatus, for a long period of time, the pigment settles. As a result, the pigment concentration in the ink in the adjacencies of the ink outlet portion located in the bottom wall of the ink container in terms of the gravity direction increases, whereas the pigment concentration in the ink in the top portion of the ink container decreases. If a recording operation is carried out in this condition, a recording head ejects ink with higher pigment concentration in the initial period of the ink consumption, whereas it ejects ink with lower pigment concentration during the latter half of the ink consumption.

FIG. 1 is a schematic drawing for showing the nonuniform pigment distribution resulting from leaving an ink container undisturbed in the printing position, in a printer. In this drawing, the internal space of the ink container is divided into four regions K, L, M, and N, which are different in pigment concentration, for the sake of convenience, although, in reality, pigment concentration gradient is continuous. According to the knowledge of the inventors of the present invention, while an ink container, the initial pigment concentration of the ink in which was 4%, was left undisturbed, in the non-recording position, in other words, while no ink flow occurred in the ink container, the pigment distribution in the ink became nonuniform, effecting the pigment concentration pattern, given in the following table.

TABLE

| | 0.5 Yr | 1 Yr | 2 Yrs |
|---|---|---|---|
| K | 2% | 1.5% | 1% |
| L | 3.5% | 4% | 3% |
| M | 5.5% | 6% | 8% |
| N | 6% | 8% | 11% |

If a printing operation is carried out in this condition, an image with a very high level of pigment concentration is formed in the initial stage of the printing, because the ink in the N region is used in the initial stage, whereas in the latter stage of the ink consumption from the ink container, the ink in the K region is consumed, producing an image with a very low level of pigment concentration. Further, if this ink container is left unused for a long period of time after a printing operation with an extremely low duty is carried out using the ink in the N region, that is, the ink used in the initial stage of ink consumption from the ink container in the above described condition, the ink outlet and its adjacencies are filled with the ink with a very high level of pigment concentration, exacerbating the problem that ink solidifies and adheres to the ink outlet and its adjacencies. As a result, it becomes impossible to recover the printing performance by the recovery mechanism in the printer. These two phenomena are big problems to be solved, in consideration of the recent demand regarding print density.

Further, it is customary that an ink container is individually shipped. Thus, while an ink container is left in the same position, during the shipment, or on a store shelf, for a long period of time, a pigment distribution similar to the above described one occurs. In particular, if an ink container is continuously left undisturbed, with its ink ejection direction being parallel to the gravity direction, a problematic phenomenon such as those described above occurs during the usage immediately following the ink container purchase. It is possible to deal with these problems by making regulations that an ink container be placed sideways, or the ink container attitude be changed once a predetermined length of time, while it is shipped, or while it is kept on a store shelf for sale. However, expecting sales personnel to carry out such operations is not realistic.

As a countermeasure for the problems regarding an ink container containing an absorbent member such as those described above, in particular, the problem of pigment settlement, there is Japanese Laid-open Patent Application 2001-030513, for example. This application is intended to make uniform the pigment distribution by placing a plurality of projections in the ink passage connecting an ink container and a head, so that the ink is stirred while it is supplied from the ink container to the head. This application is effective when the bias in the pigment distribution in the ink container is not excessive, but it cannot be said to be a satisfactory countermeasure in the case of an ink container in which pigment distribution became nonuniform while the ink container is kept in a storage, or left unused, for a long period of time.

Japanese Laid-open Patent Applications 2001-260377, and 2001-26378, 2001-260379 (USAA2001026306) disclose ink container technologies, according to which an ink container is provided with a structure for controlling the amount by which pigment settles to the adjacencies of the ink outlet of an ink container. In particular, Japanese Laid-open Patent Application 2001-260378 discloses a structural arrangement in which the coloring agent settlement in pigment-based ink is prevented by placing partitioning walls alternately in the right and left halves, in the adjacencies of the ink outlet. With the provision of this structural arrangement, the size of the space in which pigment settles is reduced, reducing thereby the amount of the change in pigment distribution. Further, as the ink is supplied to a recording head, it is made to detour around the partitioning walls, being thereby stirred. Consequently, the pigment distribution is made uniform.

However, the partitioning walls disposed alternately in the right and left halves of the ink container are extended only halfway to the opposite walls. Therefore, the portion of the ink container, through which the partitioning walls are not extended, in other words, half the ink container, does not benefit from the effects of the partitioning walls. Further, in the case that the size of the ink outlet portion is half the size of the ink container, the stirring effect created by the presence of the partitioning walls and the ink flow resulting from the ink delivery from the ink container is not fully enjoyed by the ink in the portions of the ink container free of the partitioning wall.

SUMMARY OF THE INVENTION

The present invention was made in consideration of the problems of the above described prior art, which must be solved, and its primary object is to control the pigment settlement in pigment-based ink, so that it becomes possible to provide an ink container, which can be employed by an inkjet recording apparatus to produce high quality images.

The present invention for accomplishing the above object is characterized in that an ink container comprising: a negative pressure generating member holding portion containing a negative pressure generating member in which the pigment-based ink to be supplied to an inkjet head is filled; and an ink outlet for supplying the ink to the inkjet head; an air vent for connecting the negative pressure generating member holding portion to the ambient air, further comprises: a single or plurality of ink blocking portions, wherein the ink blocking portions are extended in a manner to block the direct path for the ink to flow to the ink outlet, and also in a manner to partially partition the negative pressure generating member, and wherein the adjacent two sections of the negative pressure generating member created by the ink blocking members are connected to each other through a passage, and each of the ink blocking portions occupies no less than 50% of the cross sectional area of the ink container, at a plane perpendicular to the direct ink path to the ink outlet.

Further, an ink container comprising: a negative pressure generating member holding portion containing a negative pressure generating member in which the pigment-based ink to be supplied to an inkjet head is filled; and an ink outlet for supplying the ink to the inkjet head; and an air vent, which is connecting the negative pressure generating member holding portion to the ambient air, and is attached to the portion which will be at the bottom in terms of the gravity direction, when it is in use, further comprises: a single or plurality of ink blocking plates with an ink passage, wherein the ink blocking plates are extended in the direction perpendicular to the gravity direction, in a manner to partition the negative pressure generating member, and each of the ink blocking portions occupies no less than 50% of the cross sectional area of the ink container, at a plane perpendicular to the gravity direction.

The negative pressure generating member holding chamber for holding the negative pressure generating member is divided into a plurality of blocks by the single or plurality of portions impermeable to ink, or blocking plates. Therefore, the height of each block of the negative pressure generating member in the ink container is lower than that of the negative pressure generating member which has not been divided by the portions impermeable to ink or blocking plates. Therefore, the difference in the pigment concentration, which is created between the top and bottom portions of the negative pressure generating member in an ink container, in which pigment-based ink is contained, by pigment settlement which occurs when the ink container is left undisturbed for a long period of time, is smaller.

The negative pressure generating member may be a single-piece member in which the adjacent two of a plurality of virtually discrete blocks, which will be created by the portions impermeable to ink, or blocking plates, are continuous through an ink passage portion. This structural arrangement assures the ink supply to an inkjet; ink flow is not interrupted at the passage between the two blocks, because the passage section of the negative pressure generating member is continuous with the adjacent two blocks. Further, the negative pressure generating member may be made up of a plurality of discrete smaller negative pressure generating members separated from the adjacent negative pressure generating members by portions impermeable to ink, or blocking plates. In this case, it is desired that a structural arrangement is made so that the closer to the passage, the higher the capillary force of the negative pressure generating member, because such an arrangement ensures the continuous ink flow through the passage.

In the case that a plurality of portions impermeable to ink, or ink blocking plates, are disposed in an ink container, it is desired that a structural arrangement is made so that the projections of the ink passage portions of the negative pressure generating member, that is, the portions of the negative pressure generating member left unblocked by the portions impermeable to ink, or blocking plates, onto a plane perpendicular to the ink delivery direction or gravity direction, do not coincide. In this case, if the negative pressure generating member holding chamber are vertically divided into, for example, three sections, by two portions impermeable to ink, or two blocking plates, the pressure head in the ink passage portion between the middle and bottom negative pressure generating member holding chambers is equal to the pressure head generated only by the negative pressure generating member section in the middle negative pressure generating member holding chamber; in other words, the pressure head of the negative pressure generating member section in the top negative pressure generating member holding chamber does not apply to the ink passage portion between the middle and bottom negative pressure generating member holding chambers. Therefore, the difference in pigment concentration between the top and bottom portions of the portion of the negative pressure generating member corresponding to this passage is smaller by the amount equivalent to the reduced amount of the pressure head.

Further, a portion impermeable to ink, or a blocking plate, may be perpendicular to, or inclined a predetermined angle relative to, the ink delivery direction or gravity direction.

The present invention is applicable to an ink container which is separable from an inkjet head, and is exchangeable by a user, as well as a cartridge integrally comprising an ink container and an inkjet head, which is obvious.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 13(*b*) is another example of the absorbent member made up of a plurality of blocks; and FIG. 13(*c*) shows another example of the absorbent member made up of a plurality of blocks.

FIG. 18(*b*), another example of the absorbent member made up of a plurality of blocks; and FIG. 18(*c*) shows the pigment distribution in the absorbent member, shown in FIG. 18(*b*), made up of the plurality of blocks, after the placement thereof into the ink container.

DESCRIPTION OF THE PREFERRED EMBODIMENTS

Hereinafter, the preferred embodiments of the present invention will be described in detail with reference to the appended drawings.

(Embodiment 1)

Figure 2:
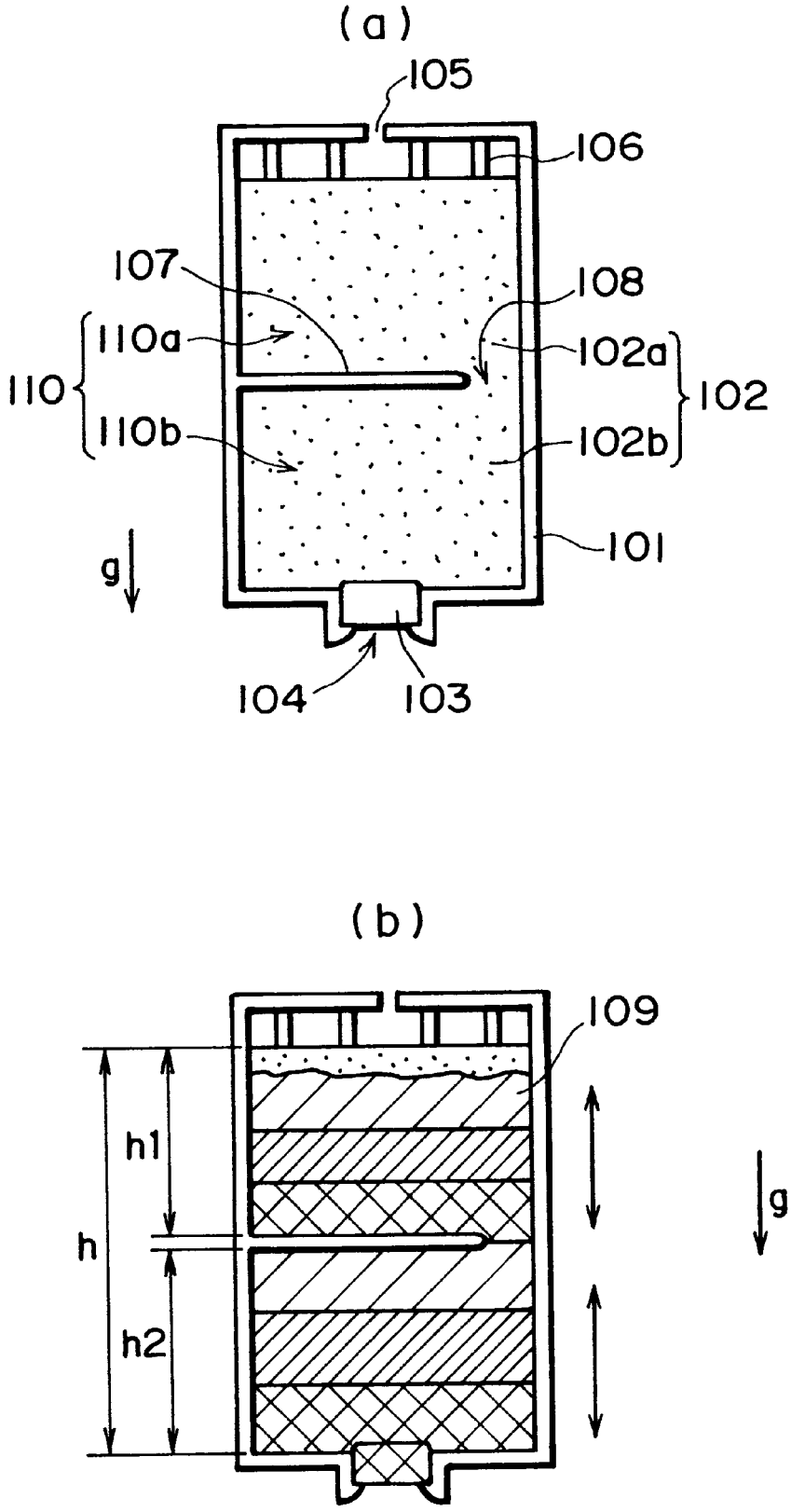
FIG. 2 is a schematic sectional view of the ink container in the first embodiment of the present invention, for showing the ink container structure and the pigment concentration gradient of the pigment-based ink.

FIG. 2(*a*) is a sectional view of the ink container in the first embodiment of the present invention.

The ink container in this embodiment comprises: an external shell 101; a negative pressure generating member 102 which is permeable by ink, is capable of retaining the ink therein, and generates negative pressure; an ink drawing member 103 for drawing the ink from the negative pressure generating member 102 to an unshown recording head; an ink outlet 104; an ambient air inlet 105 for introducing the ambient air into the external shell; a plurality of ribs 106 for securing the negative pressure generating member 102, and providing the external shell 101 with an internal air buffer chamber.

The ink container also has a partitioning wall 107, which is within the external shell 101 and extends from one of the side walls of the external shell in the direction perpendicular to the gravity direction g. This partitioning wall 107 virtually divides the negative pressure generating member 102 into a first negative pressure generating member 102*a* and a second negative pressure generating member 102*b*, and the negative pressure generating member holding chamber 110 holding the negative pressure generating member 102, into a first holding chamber 110*a* and a second holding chamber 110*b*. In other words, the partitioning wall 107 virtually divides each of the negative pressure generating members 102 and negative pressure generating member holding chambers 110 into top and bottom portions. It should be noted here that the partitioning wall 107 does not divide the negative pressure generating member holding chamber 110 into two completely separate portions; the top and bottom holding portions 110*a* and 110*b* are continuous through a passage 108. The partitioning wall 107 is structured to partition the internal space of the external shell by no less than 50% in terms of the area of the horizontal section of the external shell 101. The cross section of the passage 108 is desired to be very small.

FIG. 2(*b*) is a sectional view of the finished ink container, that is, the ink container shown in FIG. 2(*a*) after the permeation of the negative pressure generating member 102 by a predetermined amount of pigment-based ink 109. In the drawing, the pigment concentration gradient in the ink container is schematically shown in three levels differentiated by the hatching line density, although it is obvious that in reality the pigment concentration gradient does not change in three levels; it is continuous.

As is evident from FIG. 2(*b*), the top and bottom negative pressure generating member holding chambers 110*a* and 110*b*, that is, the first and second negative pressure generating member holding chambers, are connected to each other through the passage 108. Therefore, the ink in the first negative pressure generating member 102*a* is also supplied to the recording head.

Figure 1:
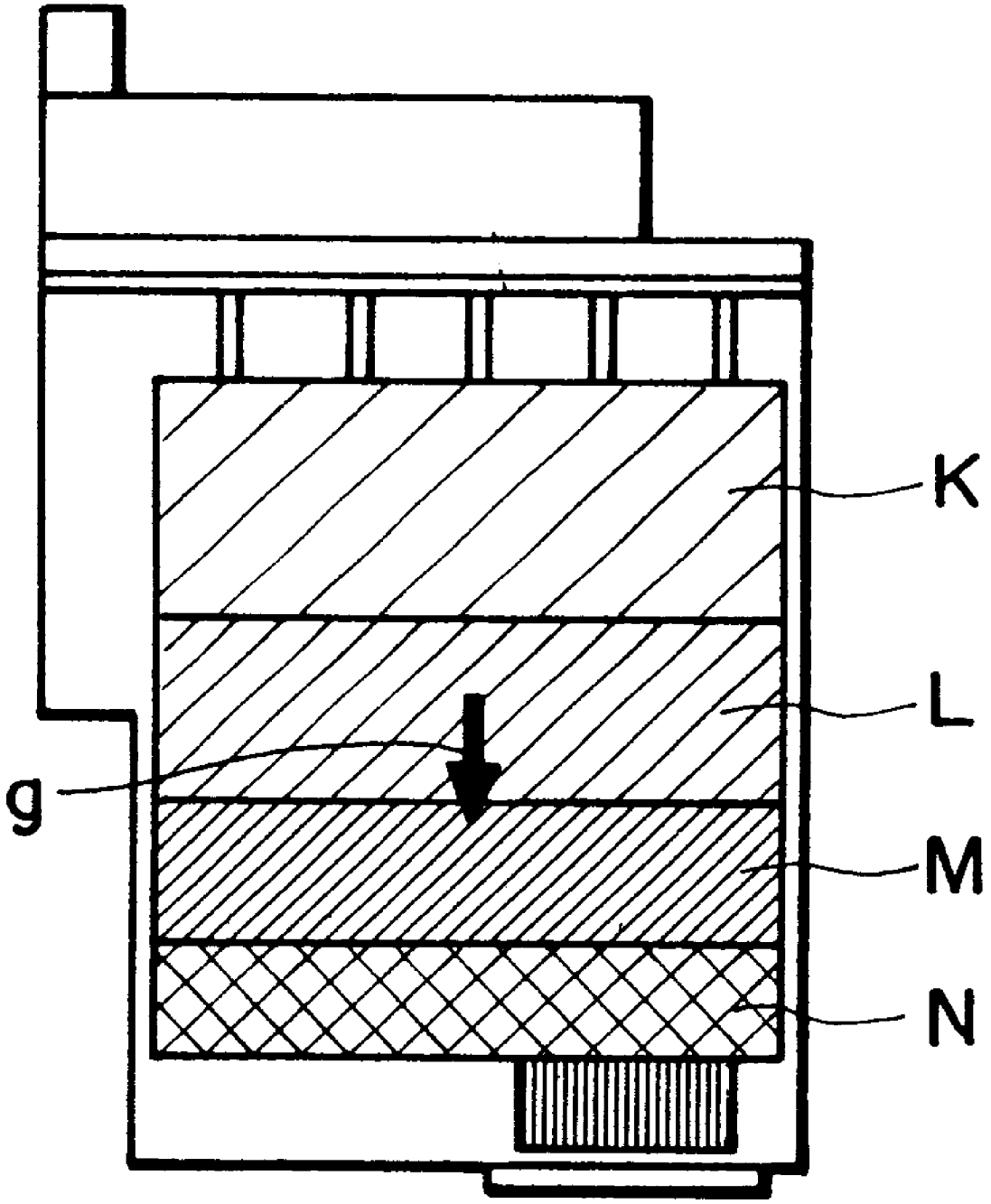
FIG. 1 is a schematic sectional view of an ink container, which contains an absorbent member, and in which pigment in the ink has settled.

If an ink container holding pigment-based ink is left unused in the same attitude for a long period of time, the pigments with a larger molecular weight settle at the bottom, effecting such a pigment distribution that the closer to the bottom, the higher the pigment concentration, as described before. In the case of the example of an ink container in accordance with the prior art shown in FIG. 1, the difference in pigment concentration between the top and bottom portions of the absorbent member in the ink container is substantial.

In comparison, in the case of the ink container in this embodiment shown in FIG. 2(*b*), the difference in pigment concentration between the top and bottom portions of the absorbent member in the ink container is relatively small for the following reason: the negative pressure generating member 102 is divided into the first and second negative pressure generating members 102*a* and 102*b*, or the top and bottom negative pressure generating members, by the partitioning wall 107. As a result, the heights h1 and h2 of the first and second negative pressure generating members 102*a* and 102*b* are approximately half the height h of the negative pressure generating member holding chamber 110, or the negative pressure generating member 102. With the heights h1 and h2 being half the height h of the negative pressure generating member 102, the pressure heads of the first and second negative pressure generating member 102*a* and 102*b* in terms of the direction in which the pigment in the negative pressure generating member 102 settles are half the head pressure of the negative pressure generating member 102, and therefore, the difference in the pigment concentration between the top and bottom portions in each of the negative pressure generating members 102*a* and 102*b* is smaller. Thus, even when ink drawn from the ink container left unused for a long period of time is used for image formation, the difference in pigment concentration between the beginning and end of the image formation is relatively small, making it possible to record a high quality image. In order to enhance this effect, it is desired that the partitioning wall 107 extends from one of the lateral walls of the ink container no less than halfway (50%) to the opposite wall, and that the passage 108 is very small, as described before. Obviously, the extension of the partitioning wall 107 and the size of the passage 108 should be within respective ranges in which the ink flow for supplying the ink to the recording head is not adversely affected.

In this embodiment, the partitioning wall 107 is an integral part of the external shell 101. This configuration, however, is not mandatory. For example, a piece of plate or sheet, discrete from the external shell 101, may be placed between the top and bottom portions of the negative pressure generating member 102. Further, when using a piece of fibrous material as the negative pressure generating member, it is possible to create the partitioning wall 107 by thermally welding a piece of resin sheet to the negative pressure generating member, or forming film across the surface of the fibrous negative pressure generating member by thermally processing the fibrous negative pressure generating member itself.

Next, referring to FIGS. 3–6, an example of a method for assembling (manufacturing) the ink container in this embodiment will be described.

Figure 3:
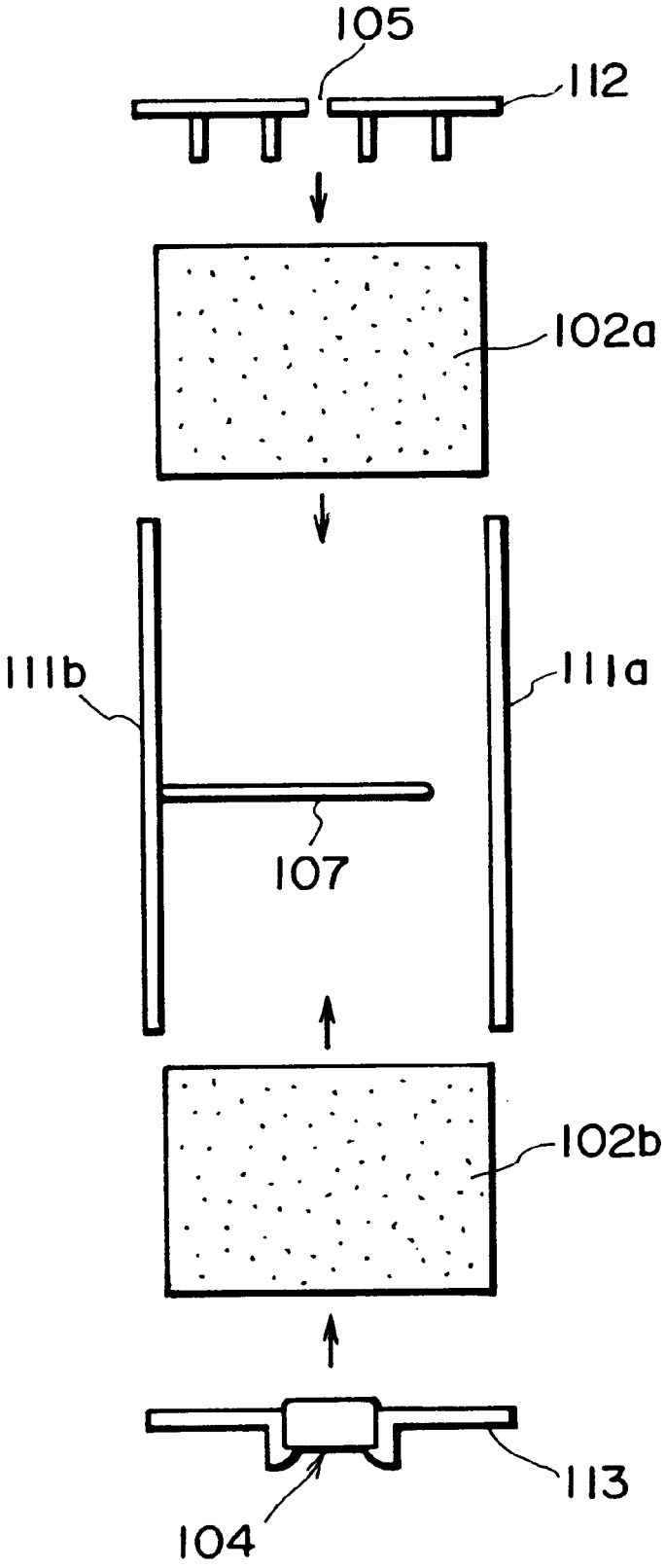
FIG. 3 is an exploded schematic sectional view of the ink container in the first embodiment of the present invention, for showing an example of a method for assembling the ink container.

First, in the case of the ink container in FIG. 3, its negative pressure generating member 102 has the first and second negative pressure generating members 102*a* and 102*b*, which are completely separate from each other. Further, the external shell of the ink container is made up of four discrete members: a top member 112, a bottom member 113 having an ink outlet 104; a first lateral member 111*a* which will become one of the lateral walls of the external shell; and a second lateral member 111*b* having the partitioning wall 107 as an integral part thereof.

Next, the order in which the ink container structured as shown in FIG. 3 is assembled will be described.

First, the first and second lateral members are to be joined to form the first and second negative pressure generating member holding chambers 110*a* and 110*b*, as well as the passage 108. Then, the first and second negative pressure generating members 102*a* and 102*b* are to be placed into the first and second negative pressure generating member holding chambers 110*a* and 110*b*, from the top and bottom sides, respectively. Then, the top and bottom members 112 and 113 are to be welded to the first and second lateral members 111*a* and 111*b* to complete the ink container.

Figure 4:
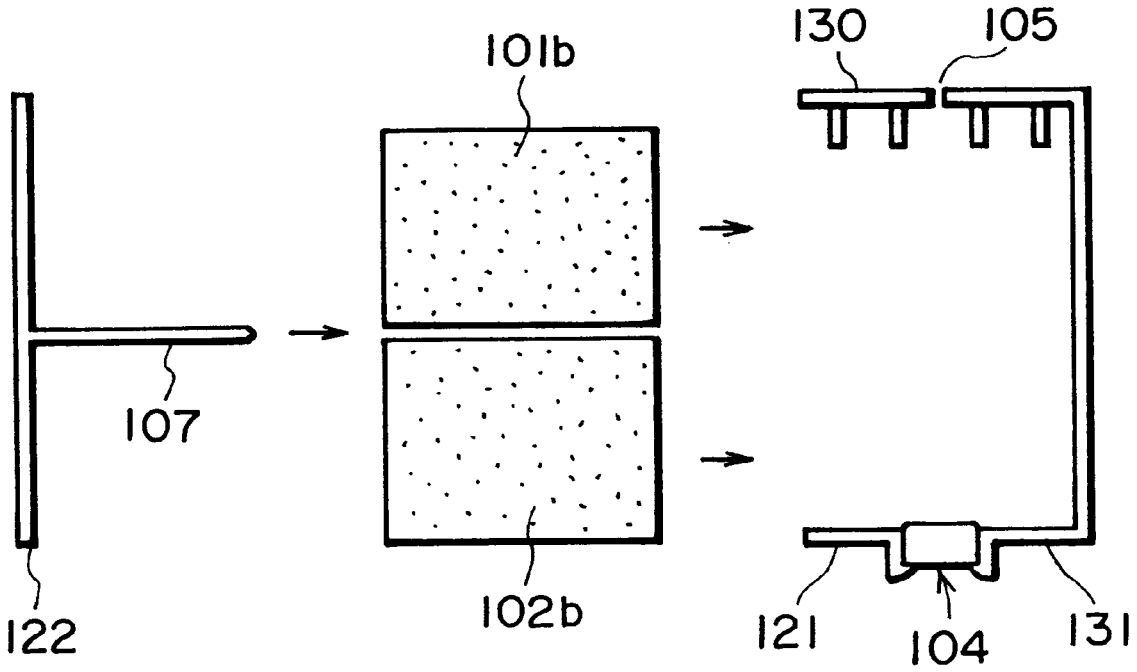
FIG. 4 is an exploded schematic sectional view of the ink container in the first embodiment, for showing another method for assembling the ink container.

The ink container shown in FIG. 4 is similar to that in FIG. 3 in that the negative pressure generating member thereof also has two discrete sections as that in FIG. 3. However, the manner in which the external shell of the ink container in FIG. 4 was divided into a plurality of members for manufacturing is different from that for the ink container in FIG. 3. In other words, FIG. 4 shows an example of a modification of this embodiment. More specifically, the ink container in FIG. 4 is made up of two discrete sections: a first member 121 integrally comprising a top wall 130 having an ambient air inlet 105, a bottom wall 131 having an ink outlet 104, and lateral walls; and a second member 122 integrally comprising a partition wall 107 and a lateral wall.

Next, the order in which the ink container structured as shown in FIG. 4 is assembled will be described.

In the case of the ink container in FIG. 4, the second member 122 may be attached to the first member 121 after inserting the first and second negative pressure generating members 102*a* and 102*b* into the first member 121 so that the partitioning wall 107 can be inserted between the first and second negative pressure generating members 102*a* and 102*b*, or the second member 122 may be inserted into the first member 121 while holding the first and second negative pressure generating members 102*a* and 102*b* to the second member 122.

Figure 5:
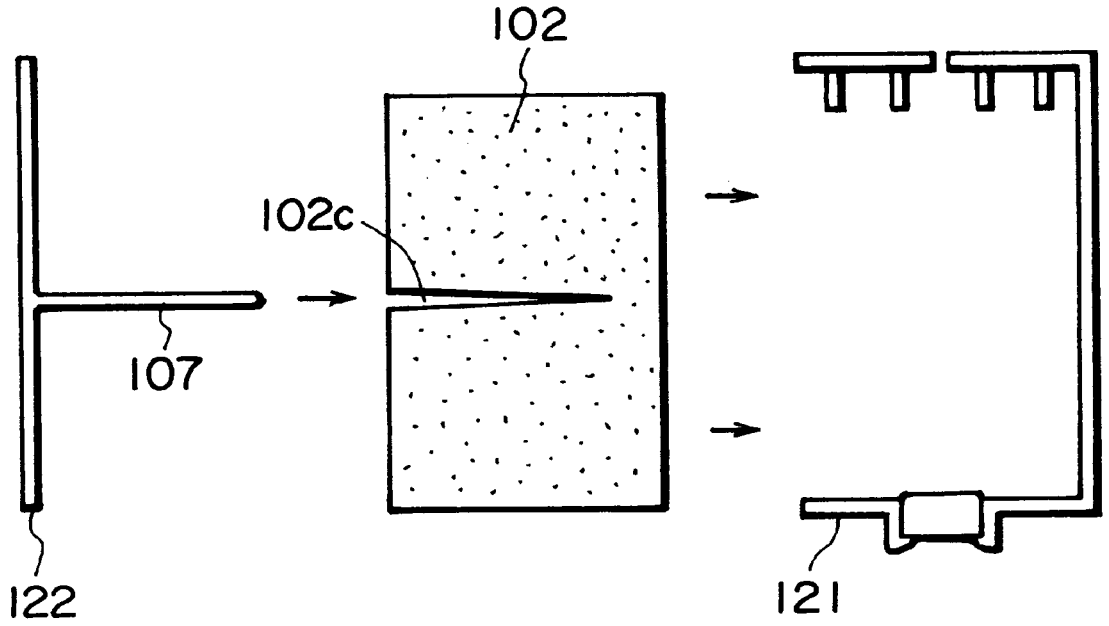
FIG. 5 is an exploded schematic sectional view of the ink container in the first embodiment, for showing another method for assembling the ink container.

In terms of the ink container design in which an ink container is divided into a plurality of pieces for manufacturing, the ink container shown in FIG. 5 is the same as the ink container in FIG. 3. In the case of the ink container in FIG. 5, however, the negative pressure generating member 102 is a single-piece component. In other words, FIG. 5 shows another example of a modification of this embodiment. More specifically, although the negative pressure generating member 102 in FIG. 5 is a single-piece component, it is provided with a cut 102*c*, into which the partitioning wall 107 is inserted to effect the ink container shown in FIG. 2, in which the negative pressure generating member 102 comprises the top and bottom portions virtually discrete from each other.

Next, the order, shown in FIG. 5, in which the ink container in FIG. 5 is assembled will be described.

In the case of the ink container in FIG. 5, the second member 122 may be attached to the first member after inserting the negative pressure generating member 102 into the first member 121 and inserting the partitioning wall 107 into the cut 102*c* of the negative pressure generating member 102, or the second member 122 may be inserted into the first member 121, while holding the negative pressure generating member 102 to the second member 122 after inserting the partitioning wall 107 into the cut 102*c* of the negative pressure generating member 102.

As for the benefits of employing a single-piece negative pressure generating member 102 as described above, component count is reduced, which in turn reduces ink container manufacturing cost. Further, the top and bottom portions of the negative pressure generating member are literally continuous through the passage, ensuring that ink smoothly flows through the passage to be supplied to the recording head; ink flow is not interrupted in the passage.

Figure 6:
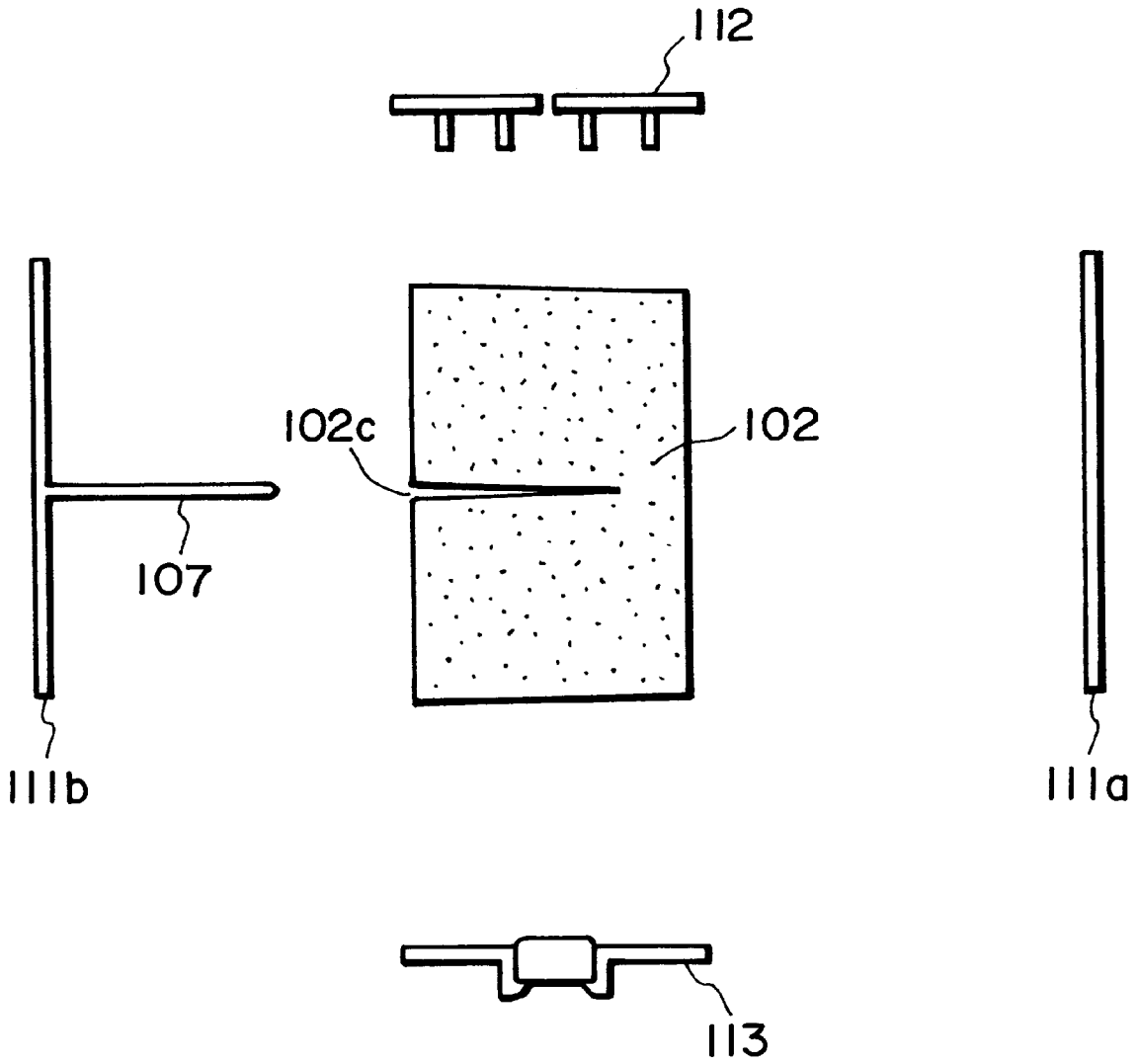
FIG. 6 is an exploded schematic sectional view of the ink container in the first embodiment, for showing another method for assembling the ink container.

The ink container shown in FIG. 6 is another example of the modification of this embodiment of the present invention. Its external shell is made up of four discrete components: a top member 112, a bottom member 113, a first lateral member 111*a*, and a second lateral member 111*b*, which are identical to those shown in FIG. 3, whereas its negative pressure generating member 102 is a single-piece component with a cut 102*c*; in other words, it is identical to the negative pressure generating member 102*c* shown in FIG. 5.

Next, the order in which the components shown in FIG. 6 are assembled into an ink container will be described.

First, the top and bottom members 112 and 113 are to be welded to the first lateral member 111*a*.

Then, the negative pressure generating member 102 is to be inserted into the box made up of the top and bottom members 112 and 113, and the first lateral member 111*a*. Lastly, the second lateral member 111*b* is to be welded to the first lateral member 111*a*, with the partitioning wall 107 inserted in the cut 102*c* of the negative pressure generating member 102. However, instead of inserting the negative pressure generating member 102 into the box made up of the top and bottom members 112 and 113, the negative pressure generating member 102 may be held to the second lateral member 111*b*, with the partitioning wall 107 fitted in the cut 102*c* of the negative pressure generating member 102. In this case, the combination of the second lateral member 111*b* and negative pressure generating member 102 is to be inserted into the above described box.

The employment of an ink container design such as those described above, in which the external shell is divided into discrete members increases component count, but provides the following benefits. For example, in the case of some ink containers, the sizes, configurations, and the like, of their external shells and negative pressure generating members 102 make it virtually impossible to properly insert the negative pressure generating member 102 into the external shell. However, the employment of the ink container design, in which the external shell and negative pressure generating member 102 are divided into a plurality of discrete members as described above, makes it relatively easy to assemble these ink containers which otherwise are virtually impossible to properly assemble.

In the above, the methods for assembling the ink container in this embodiment, and the structural variations thereof, were described. As for which method should be employed, all that is necessary is to select one of the preferable methods, based on the structure, configuration, size, component accuracy, ink delivery performance required of an ink container, and the like factors.

(Embodiment 2)

Figure 7:
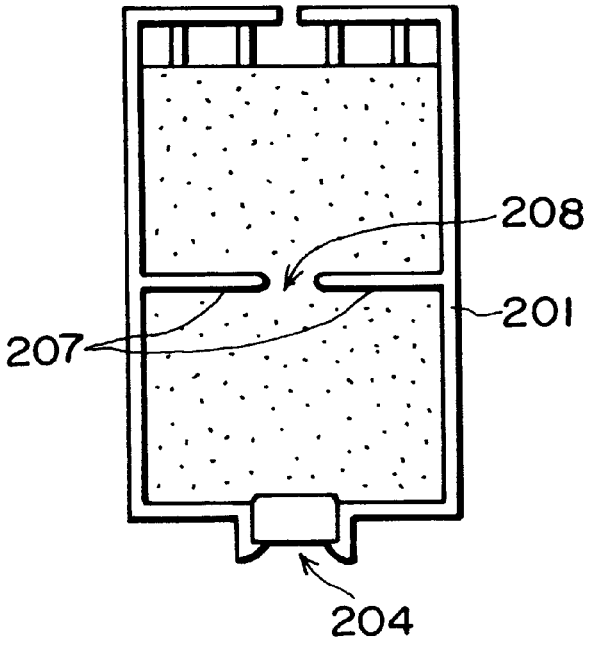
FIG. 7 is a schematic sectional view of the ink container in the second embodiment of the present invention, for showing the ink container structure and the pigment concentration gradient of the pigment-based ink.
Figure 7:
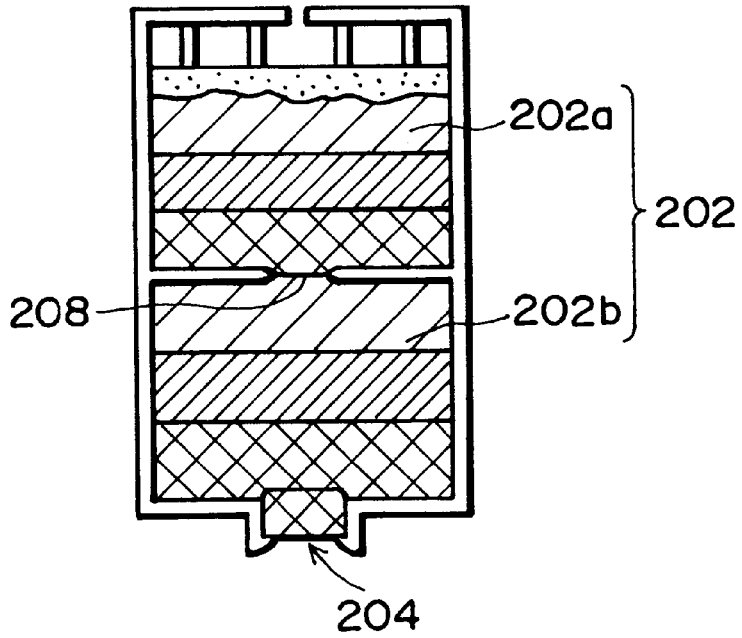

FIG. 7(*a*) is a sectional view of the ink container in the second embodiment of the present invention.

Referring to FIG. 7(*a*), in the ink container in this embodiment, the passage 208 is located approximately above the ink outlet 204; in other words, the passage 208 is located so that the direct distance between the passage 208 and ink outlet 204 becomes smaller than that in the first embodiment.

Reducing the direct distance between the passage 208 and ink outlet 204 shortens the distance the ink in the first negative pressure generating member 202*a*, or the top portion of the negative pressure generating member 202, must flow from the passage 208 to the ink outlet 204, through the second negative pressure generating member 202*b*, or the bottom portion of the negative pressure generating member 202, after flowing into the second negative pressure generating member 202*b*. Therefore, the pressure loss which occurs between the passage 208 and ink outlet 204 of the ink container in this embodiment is smaller than that in the first embodiment. Thus, the ink container structured as shown in FIG. 7(*a*) and FIG. 7(*b*) is useful, for example, when a large flow rate is required.

Like the negative pressure generating member 102 in the first embodiment, the negative pressure generating member 202 in this embodiment also has the top and bottom portions, or the first and second negative pressure generating members 202*a* and 202*b*, which is separated by the partitioning wall 207. Therefore, the heights of the first and second negative pressure generating member 202*a* and 202*b* are half the overall height of the negative pressure generating member 202. With the heights of the first and second negative pressure generating members 202*a* and 202*b* being half the height of the negative pressure generating member 202, the pressure heads of the first and second negative pressure generating member 202*a* and 202*b* in terms of the direction in which the pigment in the negative pressure generating member 202 settles are half the head pressure of the negative pressure generating member 202, and therefore, the difference in the pigment concentration between the top and bottom portions in each of the negative pressure generating members 202*a* and 202*b* is smaller. Thus, even when the ink drawn from the ink container left unused for a long period of time is used for image formation, the difference in pigment concentration between the beginning and end of the image formation is relatively small, making it possible to record high quality images.

(Embodiment 3)

Figure 8:
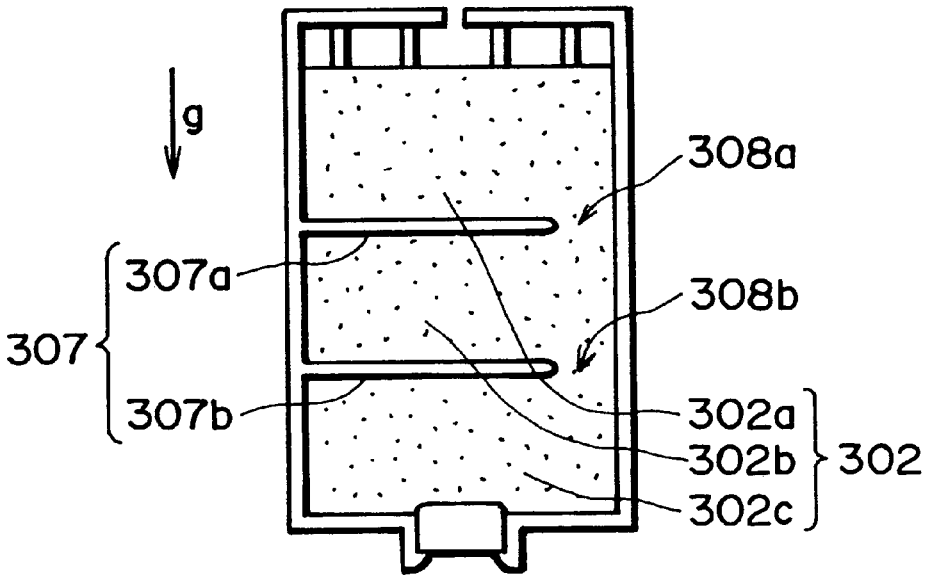
FIG. 8 is a schematic sectional view of the ink container in the third embodiment of the present invention, for showing the ink container structure and the pigment concentration gradient of the pigment-based ink.
Figure 8:
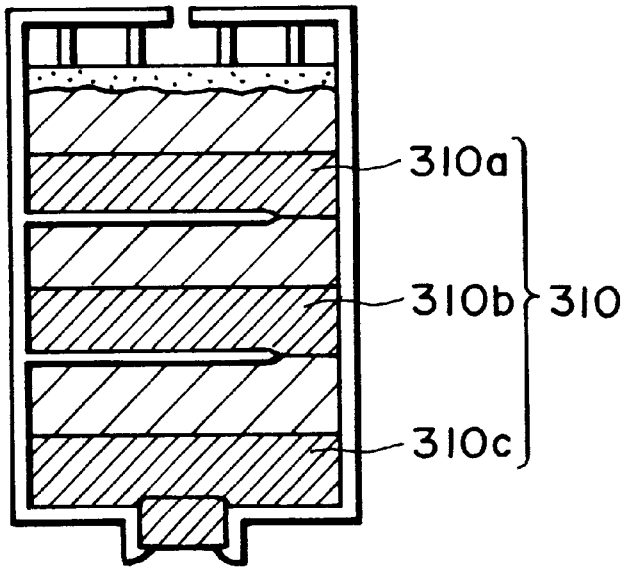

FIG. 8(*a*) is a sectional view of the ink container in the third embodiment of the present invention.

The negative pressure generating member holding chamber 310 of the ink container in this embodiment is partitioned by two partitioning walls 307: first and second partitioning walls 307*a* and 307*b*, into three negative pressure generating member holding chambers: first, second, and third negative pressure generating member holding chambers 310*a*, 310*b*, and 310*c*. The first and second chambers 310*a* and 310*b* are connected through the first passage 308*a*, and the second and third chambers 310*b* and 310*c* are connected through the second passage 308*b*.

The negative pressure generating members 302*a*, 302*b*, and 302*c* held in the chambers 310*a*, 310*b*, and 310*c*, respectively, may be independent, or may be virtually independent parts of a single-piece negative pressure generating member 302, continuous through the first and second passages 308*a* and 308*b*. In the case of the latter, the negative pressure generating member 302 is provided with two cuts, the location of which correspond to those of the first and second partitioning walls 307*a* and 307*b*.

In the case of the ink container in this embodiment, the negative pressure generating member holding chamber 310 is divided into three negative pressure generating member holding chambers: first, second, and third negative pressure generating member holding chambers 310*a*, 310*b*, and 310*c*, by the first and second partitioning walls 307*a* and 307*b* extending in the direction perpendicular to the gravity direction g. Therefore, the pressure heads of the ink, in terms of the direction in which the pigment settles, in the first, second, and third negative pressure generating members 302*a*, 302*b*, and 302*c*, held in these negative pressure generating member holding chambers, are approximately one third the pressure head in the negative pressure generating member 302 placed in a negative pressure generating member holding chamber which does not have the first and second partitioning walls 307*a* and 307*b*. Thus, the difference in the pigment concentration between the top and bottom portions in each of the negative pressure generating members 302*a*, 302*b*, and 302*c* is smaller. Therefore, even when the ink drawn from the ink container left unused for a long period of time is used for image formation, the difference in pigment concentration between the beginning and end of the image formation is even smaller than those in the first and second embodiments, making it possible to record high quality images.

This embodiment is especially useful when the ink container is relatively tall. Although, in this embodiment, two partitioning walls were used to divide the negative pressure generating member into three portions, the number of the partitioning walls does not need to be limited to two; it can be increased without creating problems. As for how many partitioning walls should be employed, all that is necessary is to determine the number in consideration of the ink container height, initial pigment concentration of the ink, required level of image quality, required volumetric efficiency of the ink (ratio of ink volume to internal volume of ink container), and the like factors.

(Embodiment 4)

Figure 9:
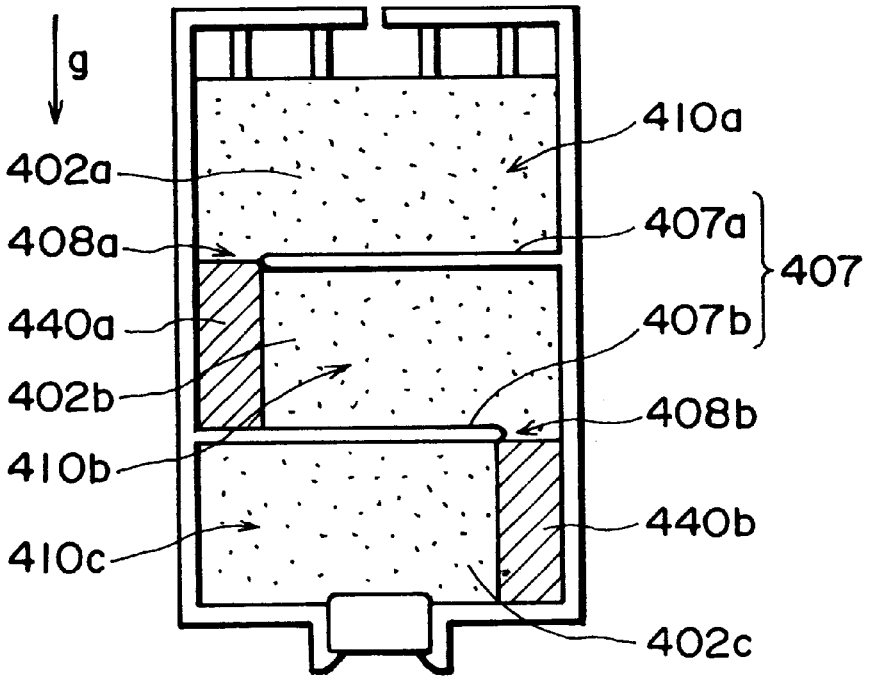
FIG. 9 is a schematic sectional view of the ink container in the fourth embodiment of the present invention, for showing the ink container structure.

FIG. 9 is a sectional view of the ink container in the fourth embodiment of the present invention.

Like the ink container in the third embodiment, the ink container in this embodiment has two partition walls, which are partitioning walls 407*a* and 407*b*. However, in the case of the ink container in this embodiment, the first passage 408*a* connecting the first and second negative pressure generating member holding chambers 410*a* and 410*b*, and the second passage 408*b* connecting the second and third negative pressure generating member holding chambers 410*b* and 410*c*, are positioned so that when their positions are projected onto a plane perpendicular to the gravity direction g, they do not coincide.

When the first and second passages 408*a* and 408*b* in the adjacent two partitioning walls 407*a* and 407*b*, respectively, are positioned so that they do not align in the vertical direction, the sum of the heights of the only adjacent two negative pressure generating members, in terms of the vertical direction, has to be taken into consideration, as far as the pigment settlement in the passage portion is concerned.

More specifically, the pressure within the first negative pressure generating member 402*a* does not apply to the second passage region 440*b* of the third negative pressure generating member 402*c*, because the first and second passages 408*a* and 408*b* are position so that they do not align in the vertical direction. Therefore, as far as the pigment settlement in the second passage region 440*b* is concerned, only the pressure head obtained by adding the height of the second negative pressure generating member 402*b* to the pressure head of the third negative pressure generating member 402*c* has to be taken into consideration. To the first passage region 440*a* of the second negative pressure generating member 402*b*, only the combination of the pressure head and the height of the first negative pressure generating member 402*a* applies.

Figure 10:
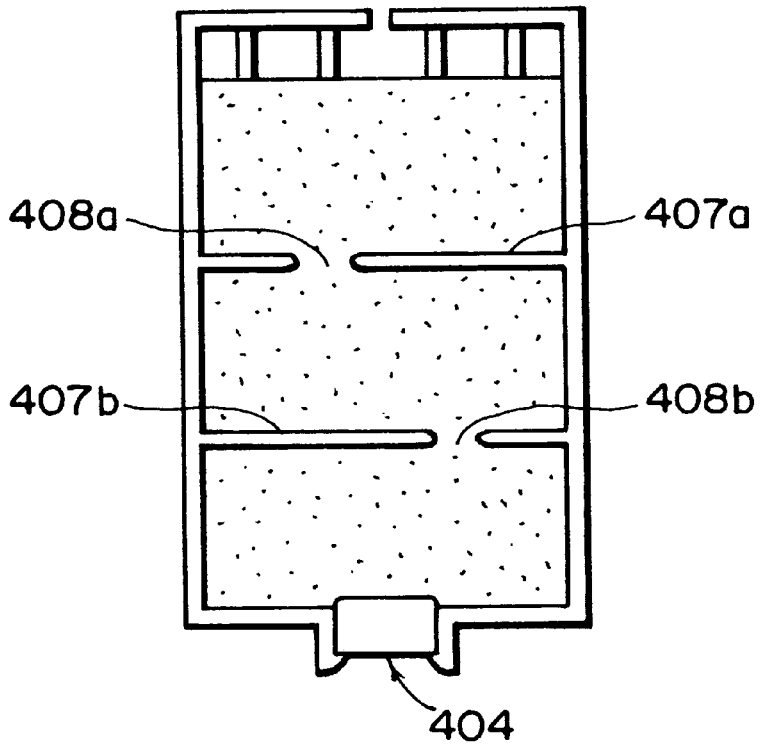
FIG. 10 is a schematic sectional view of an example of the modifications of the ink container in the fourth embodiment of the present invention, for showing the ink container structure.

Further, the first and second passages 408*a* and 408*b* may be made in the first and second partitioning walls 407*a* and 407*b*, respectively, as shown in FIG. 10 so that they do not vertically align, and also so that they are positioned close to the ink outlet 404 in terms of the horizontal direction.

This placement reduces the distances between the first and second passages 408*a* and 408*b*, and between the second passage 408*b* and ink outlet 404, reducing therefore pressure loss. Thus, an ink container structured as described above is useful when a large flow rate is required.

(Embodiment 5)

Next, the fifth embodiment of the present invention will be described with reference to a drawing.

Figure 11:
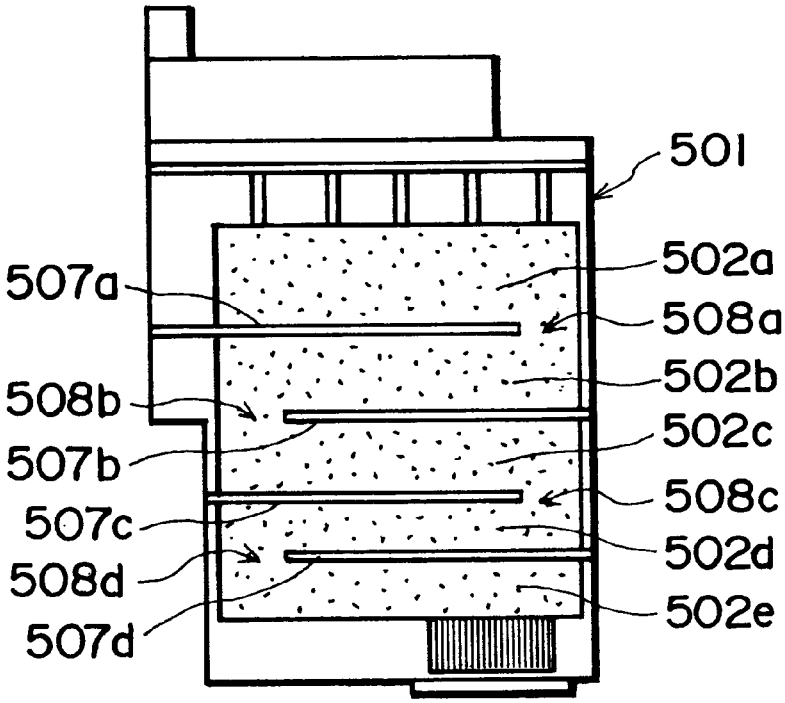
FIG. 11 is a schematic sectional view of the ink container in the fifth embodiment of the present invention, for showing the ink container structure.

FIG. 11 is a sectional view of the ink container in the fifth embodiment of the present invention.

Figure 12:
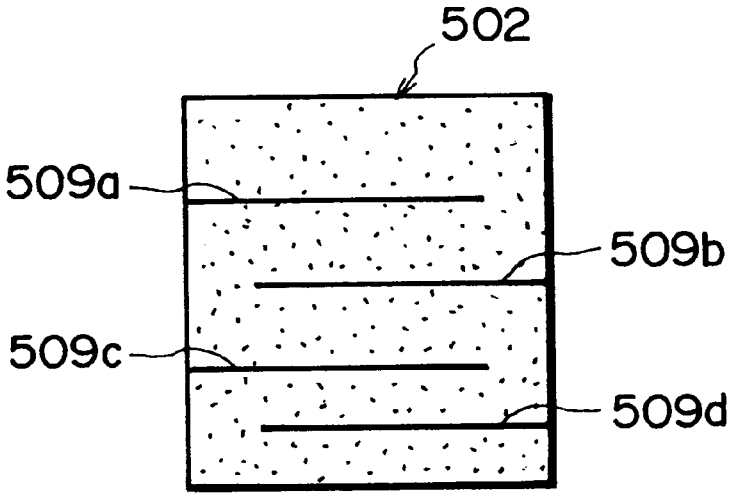
FIG. 12 is a schematic sectional view of the absorbent member in the fifth embodiment of the present invention, for showing the absorbent member structure.

An external shell 501 is provided with blocking portions 507*a*–507*d*, which are molded as integral parts of the case 501. The blocking portions 507 are not extended all the way to the opposite walls, leaving four gaps, or four ink passages O, P, Q, and R (508*a*–508*d*), one for one. Referring to FIG. 12, the blocking portions 507 of the external shell 501 can be satisfactorily inserted by providing the absorbent member with cuts 509*a*–509*d* in advance. It is also possible to divide the absorbent member 502 into five discrete absorbent members 502*a*–502*b*, and reassemble them into the external shell 501 so that they will be placed one for one in the spaces among the blocking portions 507*a*–507*d* of the external shell 501.

Each of the thicknesses S1–S5 of the absorbent members 502*a*–502*d*, respectively, is determined according to the compression ratio of each of the absorbent members 502*a*–502*d*, that is, the ratio of the height of each of the intervals of the blocking portions 507*a*–507*d*, into which the absorbent members 502*a*–502*d* are inserted one for one.

The intervals may be equal. However, it is preferable to design the ink container so that the interval height is gradually reduced toward ink outlet. With such a design, the closer an interval to the ink outlet, the gentler the pigment concentration gradation in the interval. Therefore, when such a design is employed as a countermeasure for the occurrence of a steep pigment concentration gradient resulting from the settling of pigment-based ink, not only can satisfactory results be expected, but also the stirring effect resulting from the ink flow generated by the ink delivery from the ink outlet is likely to be preferably distributed throughout each interval. Further, the synergism among these beneficial effects makes it possible to further reduce the difference in pigment concentration between the beginning and end of image formation.

Figure 13:
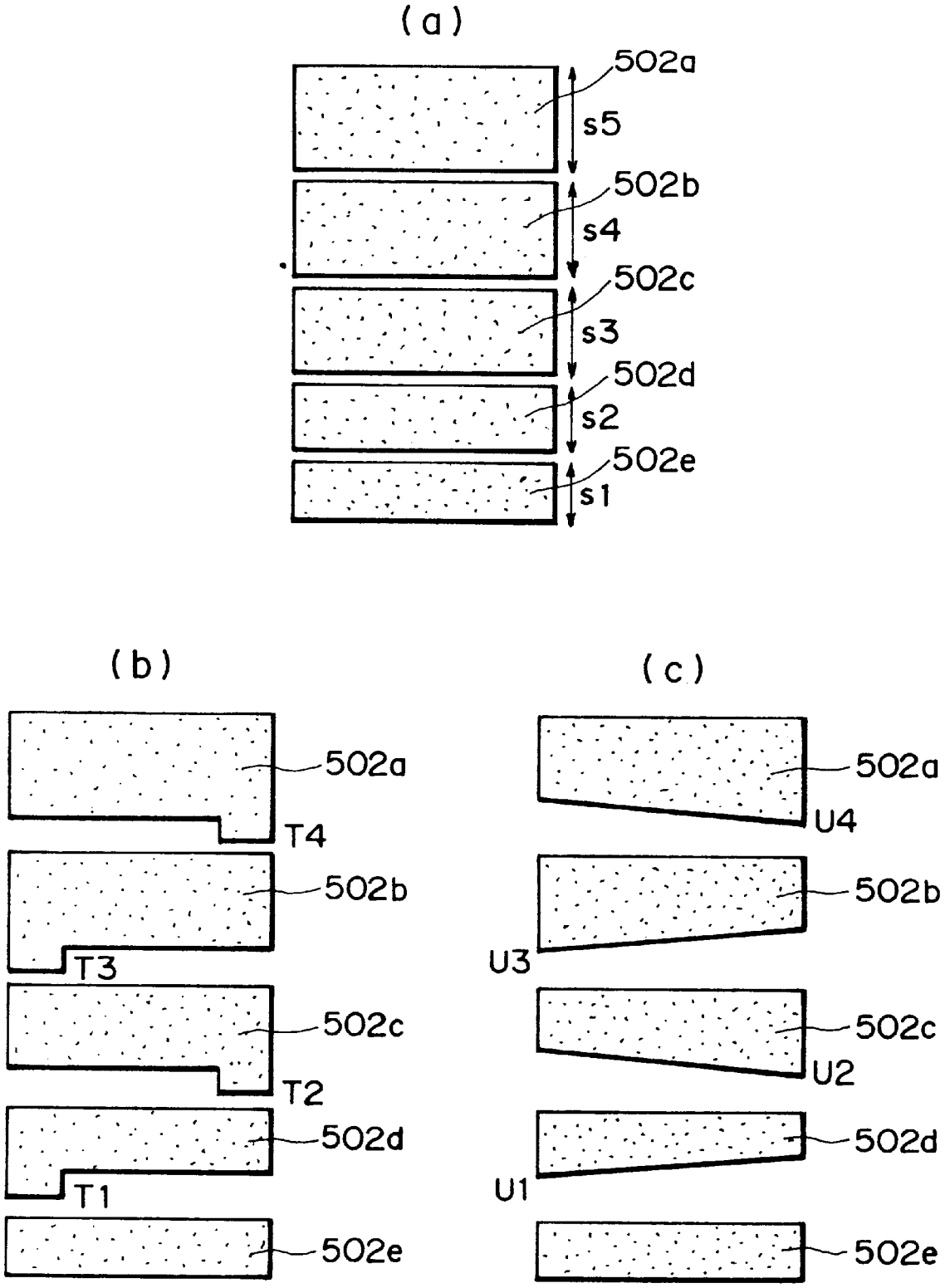
FIG. 13 is a schematic sectional view of the absorbent member in the fifth embodiment of the present invention, in which FIG. 13(*a*) shows an example of an absorbent member made up of a plurality of blocks.

FIG. 13(*b*) shows an example of a modification of this embodiment, in which the absorbent member 502 is also made up of a plurality of discrete portions (absorbent members). However, the absorbent member 502 in FIG. 13(*b*) is different from the absorbent member in FIG. 13(*a*) in that all absorbent members, except for the absorbent member 502*e*, which is the closest one to the ink outlet, are provided with projections T1–T4, one for one, which are equivalent to the passages O, P, Q, and R portions (508*a*–503*d*) shown in FIG. 11. After the completion of the assembly of the ink container, that is, with the absorbent members 502*a*–502*e* placed in the external shell, the capillary force in each of the passages O, P, Q, and R portions (508*a*–503*d*) is greater than that in the portion other than the passage, and therefore, improved ink delivery performance can be expected.

FIG. 13(*c*) shows another example of the modification of this embodiment, in which the absorbent member 502 is also made up of a plurality of discrete portions. However, the absorbent member 502 in FIG. 13(*c*) is different from the absorbent member in FIG. 13(*a*) in that all absorbent members, except for the absorbent member 502*e*, which is the closest one to the ink outlet, are tapered in terms of the horizontal direction of the ink container, the wider ends being U1–U4, one for one, which are equivalent to the passages O, P, Q, and R portions (508*a*–503*d*) shown in FIG. 11. After the completion of the assembly of the ink container, that is, with the absorbent members 502*a*-502*e* placed in the external shell, the capillary force in each of the passages O, P, Q, and R portions (508*a*–503*d*) is greater than that in the portion other than the passage, and therefore, improved ink delivery performance can be expected.

As described above, in the fifth embodiment, the external shell of the ink container is provided with the plurality of ink blocking portions absolutely impermeable to ink. The absorbent member may be a monolithic member with a single or plurality of cuts, or may be made up of a plurality of discrete portions. Further, the configuration of each of the plurality of discrete portions of the absorbent member may be varied according to a production method and/or a production apparatus.

Figure 14:
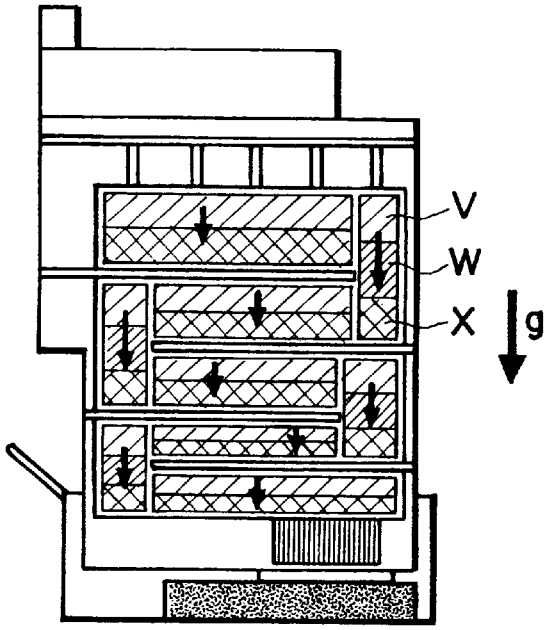
FIG. 14 is a schematic sectional view of the ink container in the fifth embodiment of the present invention, in which FIG. 14(*a*) shows the pigment concentration gradient of the pigment-based ink after the ink container was left unused for a long period of time, with the ink outlet pointed downward in terms of the gravity direction, whereas FIG. 14(*b*) shows the pigment concentration gradient of the pigment-based ink after the ink container was left unused for a long period of time, with the ink outlet pointed sideways.
Figure 14:
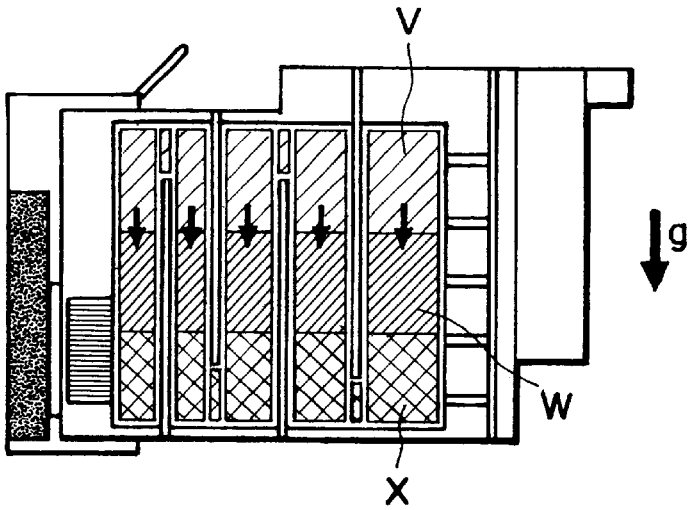

FIGS. 14(*a*) and 14(*b*) are sectional views of the ink container structured as shown in FIG. 11, for showing the changes in the pigment distribution which occurs while the ink container is left undisturbed for a long period of time after it is filled with ink which contains pigment as coloring agent. In FIG. 14(*a*), the ink container is left undisturbed in the position in which the ink outlet faces downward in terms of the gravity direction g. It is conceivable that this position is the position assumed by an ink container while the ink container is shipped, is left in a store for sale, or is left unused in a printer. FIG. 14(*a*) shows the ink container, which has been left warehoused during its shipment, and the ink outlet of which is capped. While the ink container was left in this position for a long period of time, the pigment has settled, making nonuniform the pigment distribution the ink container; in other words, the pigment concentration in one absorbent member was made different from that in the other absorbent members. For the purpose of making it easier to understand the changes in pigment distribution in the IN container, each absorbent member in FIG. 14(*a*) is divided into arbitrary regions, which are different in pigment concentration, which in this embodiment was expressed in three different levels (although, in reality, pigment concentration gradient is continuous). More specifically, in FIG. 14(*a*), a referential code X stands for the bottommost region in terms of the gravity direction g, or the region with the highest pigment concentration, of each absorbent member; V, the topmost region, or the region with the lowest pigment concentration; and a referential code W represents the region with the intermediate pigment concentration. Although, in FIG. 14, the pigment distribution is expressed in distinctive levels for the purpose of schematically expressing the image of the nonuniform pigment distribution, the actual pigment distribution is continuous across the entirety of each absorbent member.

FIG. 14(*b*) schematically shows the state of the ink container which has been left undisturbed in the horizontal position for a long period of time. Also in this case, the pigment distribution within each absorbent member has changed, roughly dividing the absorbent member into a plurality (3) of regions, V, W, and X different in pigment concentration, as in the case shown in FIG. 14(*a*): a referential code X stands for the bottommost region in terms of the gravity direction g, or the region with the highest pigment concentration, of each absorbent member; V, the topmost region, or the region with the lowest pigment concentration; and a referential code W represents the region with the intermediate pigment concentration.

Figure 15:
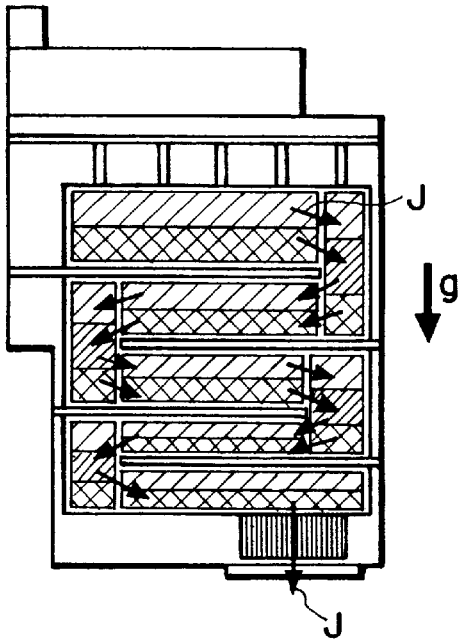
FIG. 15 is a schematic sectional view of the ink container in the fifth embodiment of the present invention, in which FIG. 15(*a*) shows the ink flow in the ink container shown in FIG. 14(*a*) after the mounting of the ink container into the image forming apparatus, whereas FIG. 15(*b*) shows the ink flow in the ink container shown in FIG. 14(*b*) after the mounting of the ink container into the image forming apparatus.
Figure 15:
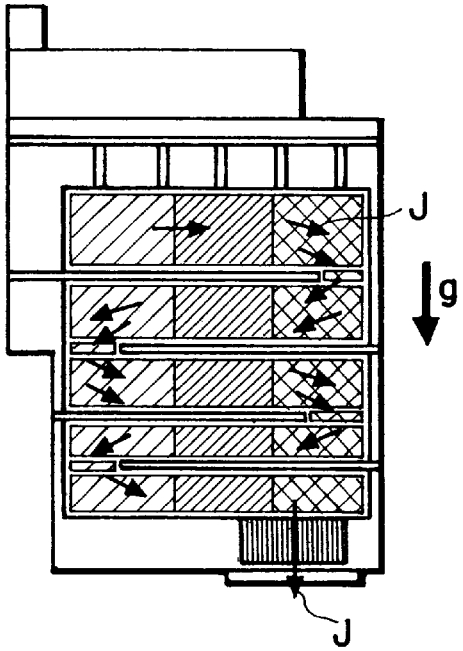

FIG. 15(*a*) is a schematic sectional view of the ink container, for showing the ink flow which occurs in the ink container as an image forming process is carried out after the mounting of the ink container shown in FIG. 14(*a*) into the inkjet head mounted in the image forming apparatus. In this case, ink flow J is created through a plurality of the absorbent member regions V, W, and X, which have resulted while the ink container was left undisturbed and are different in pigment concentration. In other words, ink flows through V→W→X→V→W→X, and so on. As a result, the pigment concentration in the ink gradually converges to the average concentration of the regions, that is, the initial pigment concentration of the ink; the change in pigment distribution which has occurred in the ink container while the ink container was left undisturbed for a long period of time is reversed by the ink flow which occurs as the ink container is used, restoring the pigment concentration to the initial concentration. Therefore, the problem caused by an ink container in accordance with the prior art that the image density effected by a given ink container at the beginning of image formation is different from that effected by the same ink container at the end of the image formation does not occur.

FIG. 15(*b*) is a schematic sectional view of the ink container, for showing the ink flow which occurs in the ink container as an image forming process is carried out after the mounting of the ink container shown in FIG. 14(*b*) into the inkjet head mounted in the image forming apparatus. In this case, ink flow J is created through a plurality of the absorbent member regions V, W, and X, which have resulted while the ink container was left undisturbed and are different in pigment concentration. In other words, ink flows through V→W→X→V→W→X, and so on. Also in this case, the pigment concentration in the flowing ink gradually converges to the average pigment concentration of the regions, that is, the initial pigment concentration of the ink; the change in pigment distribution which has occurred in the ink container while the ink container was left undisturbed for a long period of time is reversed by the ink flow which occurs as the ink container is used, restoring the pigment concentration to the initial density. Therefore, the problem caused by an ink container in accordance with the prior art that the image density effected by a given ink container at the beginning of image formation is different from that effected by the same ink container at the end of the image formation does not occur.

Regarding the intervals between the adjacent two blocking portions among the blocking portions 507*a*–507*d* in the above described embodiments, it may be expected that the effects of the present invention can be enhanced by structuring the ink container so that the closer the interval to the ink outlet, the narrower the interval. This is because the narrower the interval, the lower the degree of nonuniformity in pigment distribution in the absorbent member in the interval. The proper ranges for the number of blocking members, interval dimension, and the like, are dependent upon ink container size. In other words, it is impossible to numerically define these embodiments. However, the structural arrangement in the above described embodiments in which the blocking members are arranged so that the closer a given region of an absorbent member to the ink outlet, the narrower the interval between the blocking members in this region, is one of the examples of the desired structural arrangements.

Further, in the preceding embodiments, where there are a plurality of passages 508, they are positioned so that they do not align in the gravity direction. Therefore, as the ink in the ink container is consumed, the ink flow is created from the passage 508*a*, for example, through the absorbent member 502*b*, and to the passage 508*b* located at the opposite side; in other words, the ink is forced to flow repeatedly from one side of the ink container to the other, flowing through virtually the entire region of each absorbent member in the ink container. As a result, the pigment concentration of the flowing ink becomes the average of the pigment concentrations of the regions it goes through, gradually converging to the initial pigment concentration.

(Embodiment 6)

Figure 16:
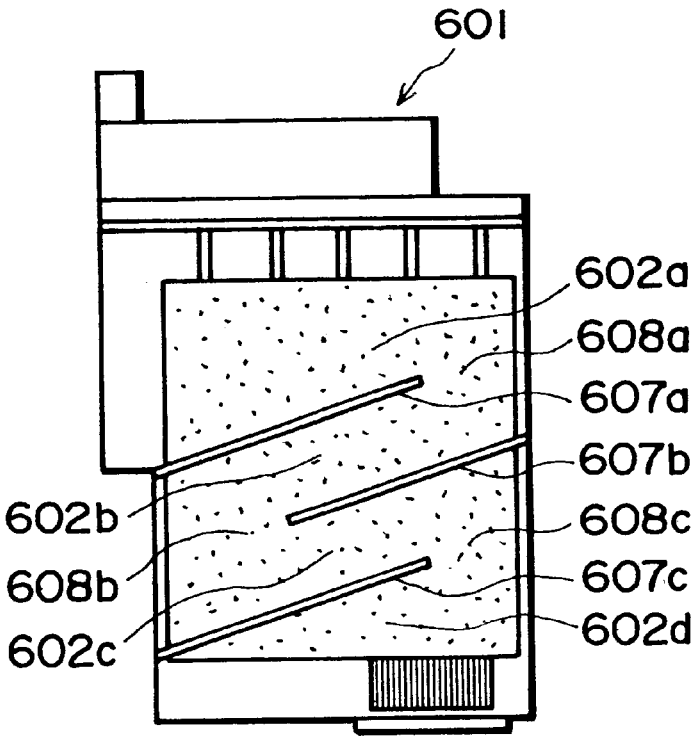
FIG. 16 is a schematic sectional view of the ink container in the sixth embodiment of the present invention, for showing the structure thereof.
Figure 17:
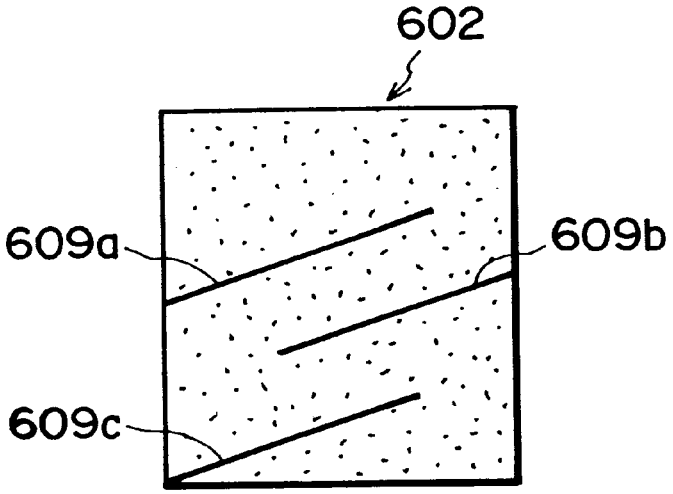
FIG. 17 is a schematic sectional view of the absorbent member in the sixth embodiment of the present invention, for showing the structure thereof.

FIG. 16 is a schematic sectional view of the ink container in the sixth embodiment. This embodiment is different from the fifth embodiment in that the blocking portions 607 in this embodiment are tilted, whereas the blocking portions 507 in the fifth embodiment shown in FIG. 11 are horizontal. The external shell 601 is provided with blocking portions 607*a*–607*d*, which are molded as integral parts of the monolithic external shell 501. The passages 608*a*, 608*b*, and 608*c* are provided by not extending the blocking portions 607*a*–607*c* to the opposite wall. FIG. 17 shows the absorbent member 602 in this embodiment. The cuts 609*a*–609*c* have been made in advance so that the blocking portions 607*a*–607*c* perfectly fit into the cuts 609*a*–609*c* as the absorbent member 602 is inserted into the external shell 601.

Figure 18:
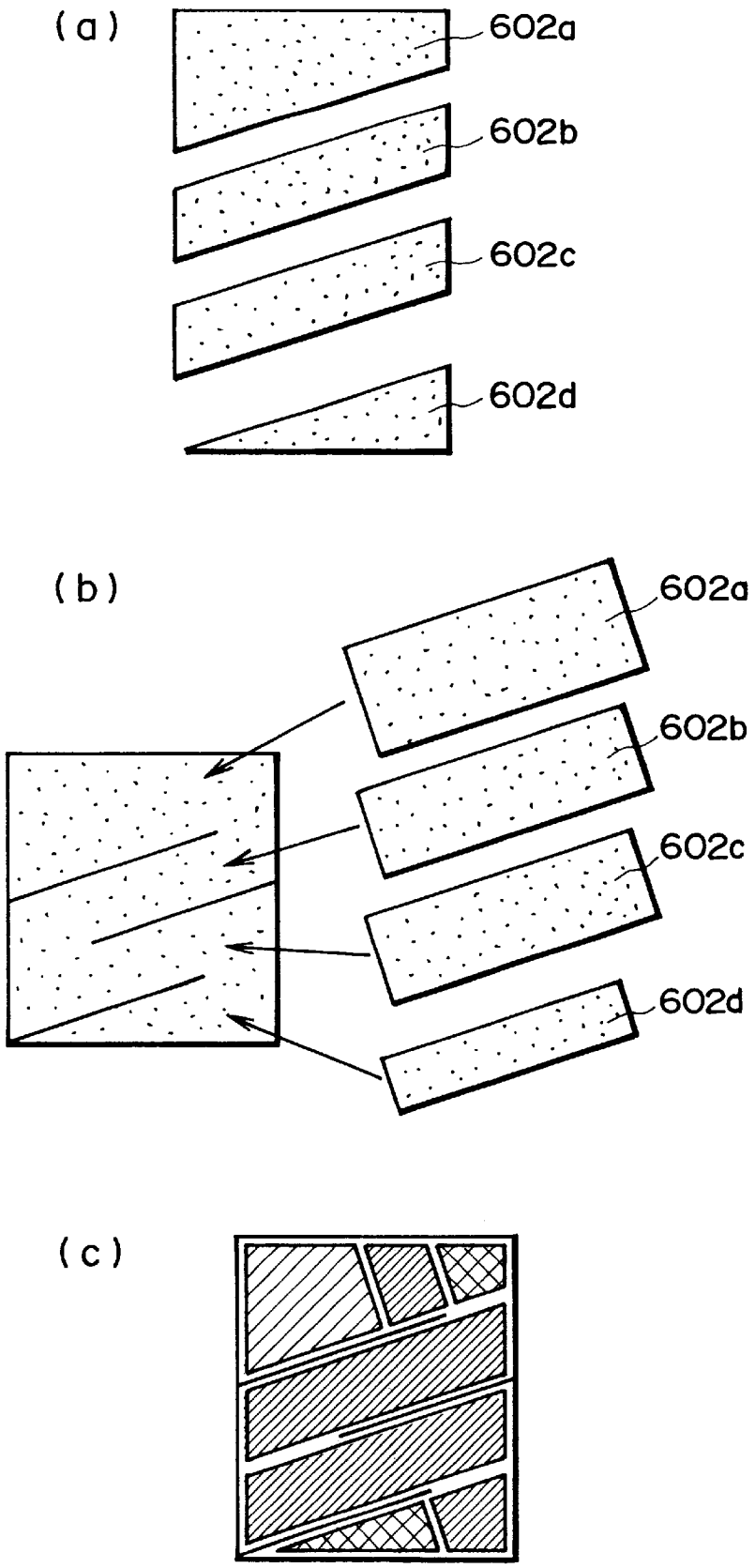
FIG. 18 is a schematic sectional view of the absorbent member in the sixth embodiment of the present invention, in which FIG. 18(*a*) shows an example of an absorbent member made up of a plurality of blocks.

FIG. 18(*a*) shows another example of the modification of this embodiment, in which the absorbent member 602 is made up of a plurality of smaller absorbent members. In the case of the this example, four smaller absorbent members 602*a*–602*d* are employed in combination to produce the same functions as the absorbent member 602 in FIG. 17. The thickness and configuration of each of the absorbent members 602*a*–602*d* are determined according to the height of the interval between the corresponding cuts 609, and the compression ratio of the absorbent member in the interval between the corresponding blocking portions 607, in FIG. 17.

FIG. 18(*b*) shows another example of the modification of this embodiment, in which the absorbent member 602 is also made up of a plurality of smaller absorbent members. This example is different from the preceding example shown in FIG. 18(*a*) in that all of the smaller absorbent members in this example are in the form of a rectangular solid. Also in this example, the thickness and configuration of each of the absorbent members are determined according to the height of the interval between the corresponding cuts 609, and the compression ratio of the absorbent member in the interval between the corresponding blocking portions 607, in FIG. 17.

FIG. 18(*c*) is a schematic sectional view of the ink container, for showing the pigment distribution in the absorbent member 602 in the external shell 601. In the drawing, the pigment concentration is roughly expressed in three levels: sparse, medium, and dense levels. Regarding this pigment concentration gradient, optimizing the above described compression ratios makes it possible to allow the ink to smoothly flow in response to ink consumption, positively affecting the pigment concentration averaging effect.

Figure 19:
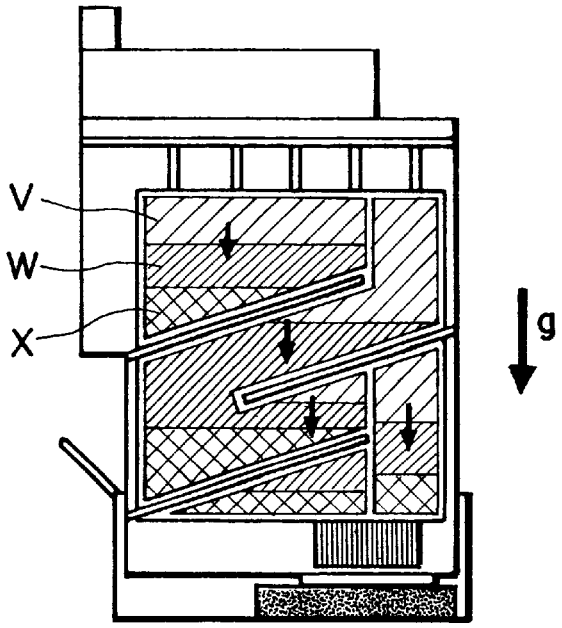
FIG. 19 is a schematic sectional view of the ink container in the six embodiment of the present invention, in which FIG. 19(*a*) shows the pigment concentration gradient of the pigment-based ink after the ink container was left unused for a long period of time, with the ink outlet pointed downward in terms of the gravity direction, whereas FIG. 19(*b*) shows the pigment concentration gradient of the pigment-based ink after the ink container was left unused for a long period of time, with the ink outlet pointed sideways.
Figure 19:
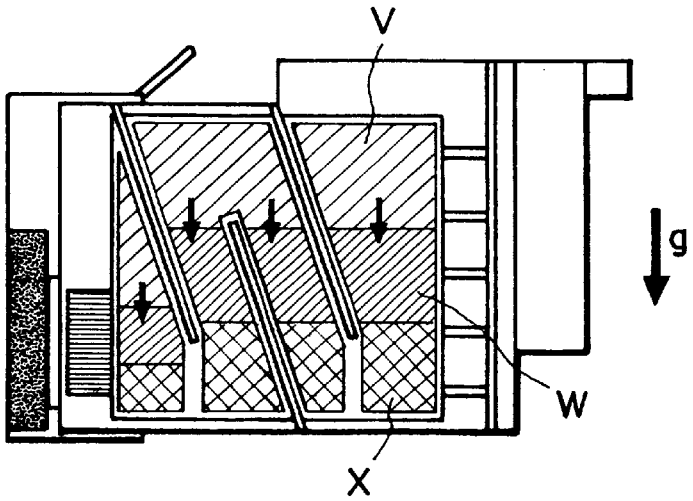

FIG. 19(*a*) is a schematic sectional view of the ink container shown in FIG. 16 left unused for a long period of time after being filled with such ink that uses pigment as coloring agent, for showing the pigment concentration gradient of the pigment-based ink after the ink container was left undisturbed for a long period of time. Here, the meaning of schematic is the same as that used in the description of FIG. 14. The attitude in which the ink container is left undisturbed in FIG. 19(*a*), is the same as that in FIG. 18(*a*), in which the ink outlet faces downward, whereas the attitude in which the ink container left undisturbed in FIG. 19(*b*) is the same as that in FIG. 18(*b*), in which the ink outlet faces sideways. While the ink container is left undisturbed in the above described attitude, each absorbent member divides into a plurality of regions different in pigment concentration, which in this embodiment is expressed in three levels, represented by referential codes V, W, and X (also in this embodiment, pigment concentration levels are arbitrary levels as described with reference to FIG. 14). More specifically, a referential code X stands for the region with the highest pigment concentration, or the bottommost region of each absorbent member section, in terms of the gravity direction g; V, the region with the lowest pigment concentration, or the topmost region of each absorbent member section; and a referential code W stands for the region with the intermediate pigment concentration.

Figure 20:
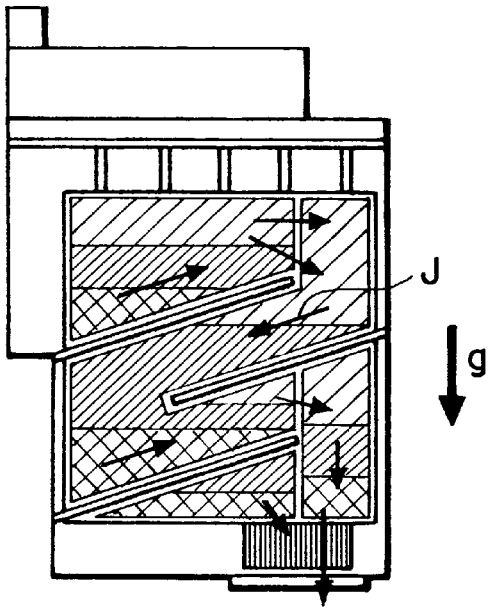
FIG. 20 is a schematic sectional view of the ink container in the sixth embodiment of the present invention, in which FIG. 20(*a*) shows the ink flow in the ink container shown in FIG. 19(*a*) after the mounting of the ink container into the image forming apparatus, whereas FIG. 20(*b*) shows the ink flow in the ink container shown in FIG. 19(*b*) after the mounting of the ink container into the image forming apparatus.
Figure 20:
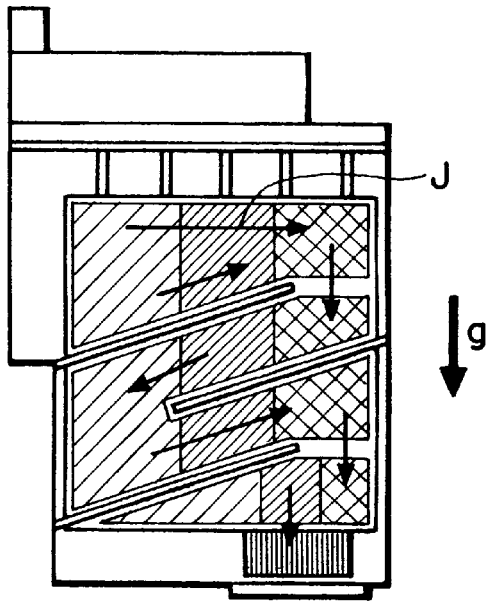

FIG. 20(*a*) is a drawing for showing the ink flow which occurs in the ink container, shown in FIG. 19(*a*), mounted in the inkjet head mounted in a printer as an image is printed. In the drawing, the ink flow J is created through a plurality of the absorbent member regions V, W, and X, which have resulted while the ink container was left undisturbed and are different in pigment concentration. In other words, ink flows through V→W→X→V→W→X, and so on. Also in this case, the pigment concentration in the flowing ink gradually converges to the average pigment concentration of the regions, that is, the initial pigment concentration of the ink; the change in pigment distribution which has occurred in the ink container while the ink container was left undisturbed for a long period of time is reversed by the ink flow J which occurs as the ink container is used, restoring the pigment concentration to the initial pigment concentration. Therefore, the problem caused by an ink container in accordance with the prior art that the image density effected by a given ink container at the beginning of image formation is different from the image density effected by the same ink container at the end of the image formation, does not occur.

FIG. 20(*b*) is a drawing for showing the ink flow which occurs in the ink container, shown in FIG. 19(*b*), mounted in the inkjet head mounted in a printer, as printing is carried out. In the drawing, the ink flow J is created through a plurality of the absorbent member regions V, W, and X, which have resulted while the ink container was left undisturbed and are different in pigment concentration. In other words, ink flows through V→W→X→V→W→X, and so on. Also in this case, the pigment concentration in the flowing ink gradually converges to the average pigment concentration of the regions, that is, the initial pigment concentration of the ink, as in the case of the ink container shown in FIG. 20(*a*); the change in pigment distribution which has occurred in the ink container while the ink container was left undisturbed for a long period of time is reversed by the ink flow J which occurs as the ink container is used, restoring the pigment concentration to the initial pigment concentration. Therefore, the problem caused by an ink container in accordance with the prior art that the image density effected by a given ink container at the beginning of image formation is different from the image density effected by the same ink container at the end of the image formation, does not occur.

(Embodiment 7)

Figure 21:
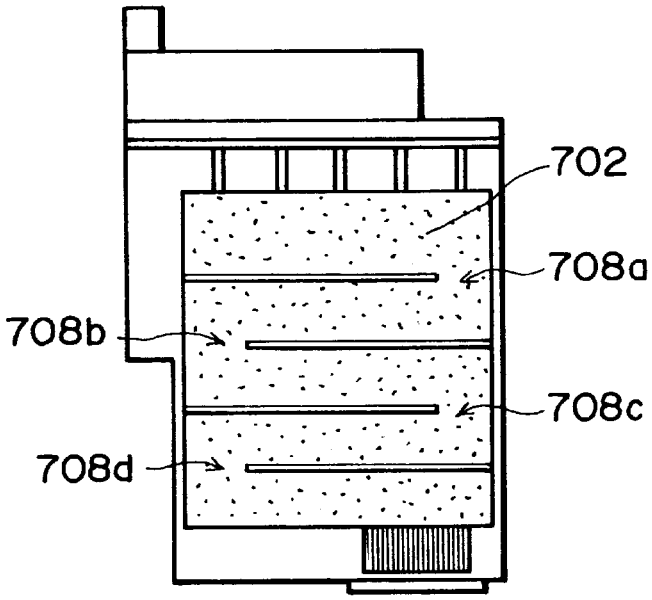
FIG. 21 is a schematic sectional view of the ink container in the seventh embodiment of the present invention, for showing the structure thereof.

FIG. 21 is a schematic sectional view of the ink container in the seventh embodiment of the present invention.

The external shell of this ink container is similar to the ink container in accordance with the prior art. However, this ink container is different from those in the fifth and sixth embodiments in that the blocking members 710 impermeable to ink are not the integral parts of the external shell, and that they have been inserted in advance into the absorbent member 702 before ink container assembly. Further, the absorbent member 702 is provided with four ink passages O, P, Q, and R (708*a*–708*d*), and the portions other than the four ink passages are blocked by the blocking members 702.

Figure 22:
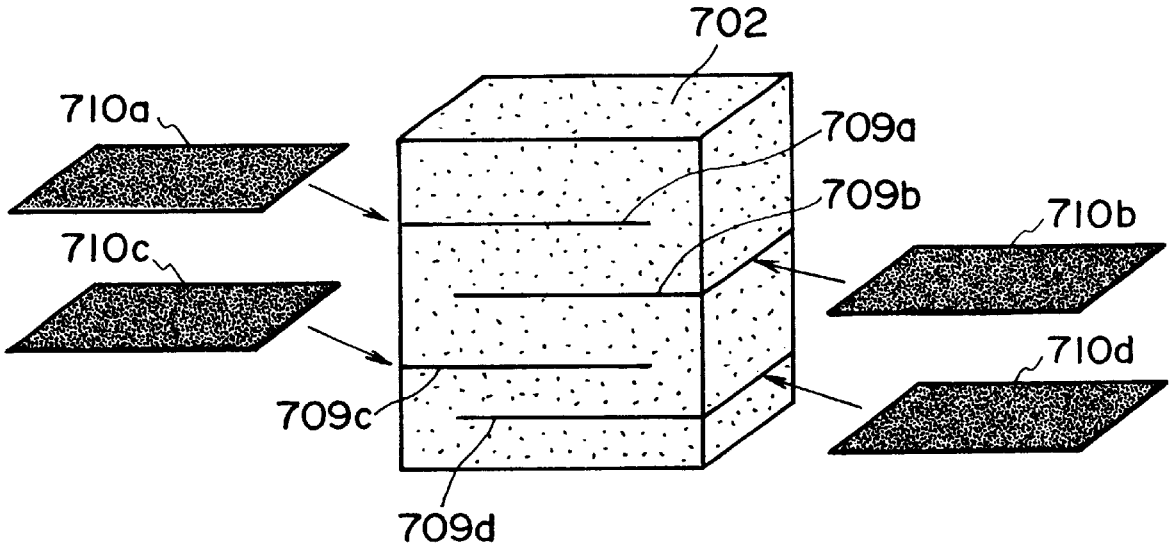
FIG. 22 is an exploded perspective view of the absorbent member in the seventh embodiment of the present invention, for showing the structure thereof.

FIG. 22 is a perspective view of the absorbent member 702 in this embodiment. This absorbent member 702 has four cuts 709*a*–709*d*, which are fitted with four blocking members 710*a*–710*d*, respectively. With the absorbent member 702 being in an external shell 702, which is impermeable to ink and is the same in structure as the one in shown in FIG. 11, the blocking members 710*a*–710*d* display the same effects as those shown in FIG. 11.

Figure 23:
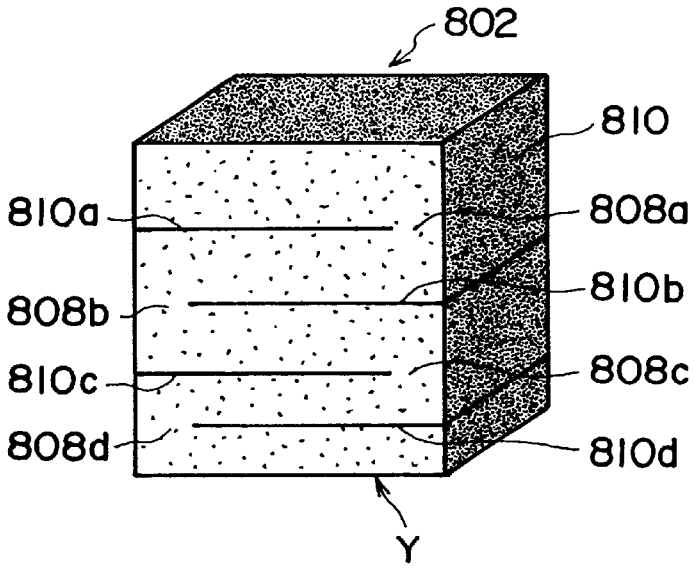
FIG. 23 is a schematic perspective view of an example of the modifications of the absorbent member in the seventh embodiment of the present invention, for showing the structure thereof.

FIG. 23 shows an example of the modification of this embodiment, in which four blocking members 810*a*–810*d* similar to the four blocking members 710*a*–710*d* shown in FIG. 21 are integral parts of a monolithic blocking member 810. More specifically, the absorbent member in FIG. 23 is created using the following method: First, to the top and bottom surfaces of a long piece of material for the absorbent member 802, two long sheets of material for the blocking portion 710 are thermally welded one for one, covering the entireties of the surfaces. Then, the combination is folded in a zigzag manner, creating the absorbent member 802 which has the blocking portions 810*a*–810*d*, and passage portions 808*a*–803*d*. Then, the thus created absorbent member 802 is placed in an external shell similar to the one shown in FIG. 11, completing an ink container having the blocking portions and passage portions. It should be noted here that the Y portion in FIG. 23 is the ink outlet, being therefore void of a blocking portion.

The absorbent member material having a structure suitable for forming an absorbent member by thermally welding the sheet of blocking portion material to the top and bottom surfaces of the absorbent member material is a material formed of PP fibers, since a sheet of the material for a blocking portion can be easily welded to a material formed of PP fibers, by structuring the blocking portion material sheet in two layers: one made of PP fibers, the melting point of which is the same as that of the PP fibers for the absorbent member, and the other made of PP fibers, the melting point of which is higher than that of the PP fibers for the absorbent member. Further, adjusting the thickness of a sheet of the material for a blocking portion to prevent the sheet from becoming excessively rigid makes it possible to fold the aforementioned welded combination in a zigzag manner as shown in FIG. 23.

Figure 24:
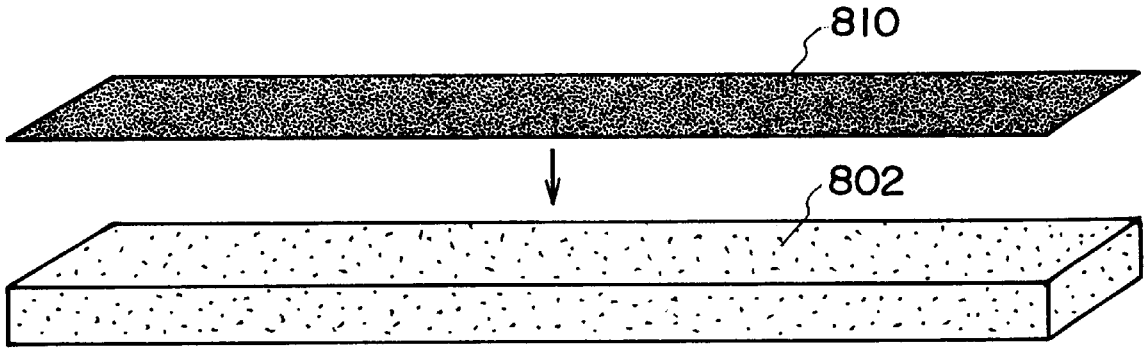
FIG. 24 is a schematic perspective view of another example of the modifications of the absorbent member blocks used to form the absorbent member shown in FIG. 23, for showing the structure thereof.
Figure 25:
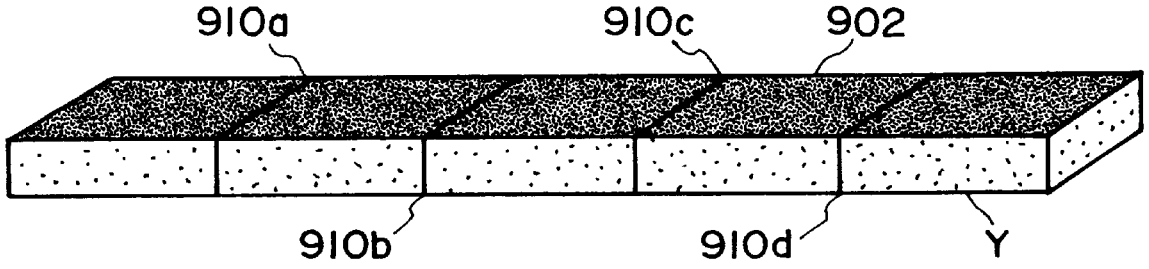
FIG. 25 is a schematic perspective view of another example of the modifications of the absorbent member blocks used to form the absorbent member shown in FIG. 23, for showing the structure thereof.

Further, referring to FIG. 25, when the absorbent member 902 is formed of PP fibers, a film layer having the same effects as those of a blocking sheet shown in FIG. 24 can be formed across the surface of the absorbent member 902, by applying a proper amount of heat to the surfaces, since the application of the proper amount of heat melts the PE portions of the PP fibers, and the melted PE portions fill the capillary force generating gaps in the surface portions of the absorbent member 902.

The surface layer created by melting the surface portion of the absorbent member 902 is relatively rigid. Therefore, it is recommended that the top and bottom surface layers are provided with cuts 910*a*–910*d*, which are placed as shown in FIG. 25, that is, alternately placed in the top and bottom surface layers, so that the above described zigzag folding becomes possible. By not extending the cuts all the way to the opposite surface layer, ink passage portions are structured. Further, in order to allow ink to pass the portion Y, which will be connected to the ink outlet, no heat should be applied to the portion Y.

As described above, according to one of the characteristic aspects of the present invention, the height of each negative pressure generating member is reduced by dividing the negative pressure generating member holding chamber, with the use of a single or plurality of ink blocking portions extending perpendicular to the ink delivery direction, or gravity direction. Therefore, the pigment in an ink container in accordance with the present invention settles in a controlled pattern. Thus, there is little difference in pigment concentration between the ink delivered from an ink container in accordance with the present invention at the beginning of an image forming operation and the ink delivered therefrom at the end of the image forming operation, even when the ink container is used for a recording operation carried out by an inkjet recording apparatus after the ink container is left undisturbed for a long period of time. Therefore, high quality images can be recorded.

According to another aspect of the present invention, an ink container for supplying an inkjet head with pigment-based ink comprises a single or plurality of ink holding members, and a single or plurality of plates impermeable to ink, that is, ink blocking plates, wherein each ink blocking plate is positioned in the absorbent member, or between the absorbent members, at a predetermined angle relative to the gravity direction, and is extended to cover 50% or more of the area of the ink container in terms of the horizontal cross section. Therefore, even after the ink container, or the combination of an inkjet head and the ink container attached thereto, was left undisturbed in a shipment package, with the ink delivery direction of the ink container being parallel to the gravity direction, the pigment concentration of the ink delivered through the ink outlet of the ink container converges to the predetermined initial pigment concentration as the ink in the ink container begins to be consumed, that is, as a printer in which the ink container has been mounted begins to print an image. Thus, there is little difference in pigment concentration between the ink delivered at the beginning of the printing operation and the ink delivered at the end of the printing operation. Further, even when the ink container is left unused after the mounting of the container into the printer, the ink outlet is not filled with ink high in pigment concentration. Therefore, the ink outlet is not plugged up by solidified ink, making it possible to package the ink container for shipment, with an inkjet attached to the ink container.

According to another aspect of the present invention, the ink blocking plate can be formed as a part of a monolithic ink container external shell. In this case, the component count of an ink container in accordance with the present invention remains the same as that of an ink container in accordance with the prior art, adding virtually nothing to ink container cost. Also in this case, the ink holding member must be provided with cuts, the positions of which match those of the ink blocking plates of the ink container external shell, making it necessary for the ink holding member to be inserted sideways into the external shell of the ink container when assembling the ink container.

According to another aspect of the present invention, the plates impermeable to ink may be fitted in advance into the cuts, one for one, of the ink holding member, to obtain the same effects as those described above. In this case, the ink container can be assembled in the same manner as an ink container in accordance with the prior art.

The plate impermeable to ink may be formed of a pair of resin sheets thermally welded to the ink holding member. In this case, the two processes for manufacturing the ink container in accordance with the preceding aspect of the present invention, that is, the process for providing the ink holding member with the cuts, and the process for placing the members impermeable to ink in the cuts, one for one, can be finished through a single process, in which the pair of resin sheets impermeable to ink is thermally welded to the ink holding member.

Further, the same effects as those obtained by the provision of the above described plates impermeable to ink can be obtained by filling the ink holding force generating gaps in the predetermined surface portions of the ink holding member by thermally processing the surfaces.

Regarding the above described structural arrangements, employing a plurality of discrete ink holding members increases component count, but simplifies each of the assembly processes, and also, makes it possible to deal with an ink container complicated in configuration.

According to another aspect of the present invention, two or more plates impermeable to ink are placed in the external shell of an ink container, in such a manner than the adjacent two plates do not align in terms of the gravity direction. Therefore, the pigment concentration in the ink container, which has become nonuniform while the ink container was left alone, more efficiently converges to the predetermined initial uniform pigment concentration.

Further, there is a possibility that placing the plates impermeable to ink in the ink holding member, in such a manner that the adjacent two plates do not align in the gravity direction, and that the plates become parallel to each other, will make it easier to employ a plurality of ink holding members, and to simplify the assembly processes.

According to another characteristic aspect of the present invention, an ink container is separable from an inkjet head by a user, and also exchangeable by a user.

The present invention is applicable to all ink containers for holding ink which uses pigment as coloring agent, and ink containers which are separable from an inkjet head by a user and also exchangeable by a user. The present invention also displays satisfactory results when applied to a cartridge integrally comprising an ink container and an ink jet head.

While the invention has been described with reference to the structures disclosed herein, it is not confined to the details set forth, and this application is intended to cover such modifications or changes as may come within the purposes of the improvements or the scope of the following claims.

What is claimed is:

1. An ink container comprising:

a negative pressure generating member accommodating portion for accommodating a negative pressure generating member for retaining therein pigment ink to be supplied to an ink jet head;

an ink supply port for supplying the ink to said ink jet head;

an air vent for fluid communication between said negative pressure generating member accommodating portion and an ambient air; and an ink non-transmitting portion for partly blocking flow of the ink in the negative pressure generating member toward said ink supply port, wherein fluid communication is enabled except for the non-transmitting portion, and a sectional area, across a general direction of the flow of the ink toward said ink supply port in said negative pressure generating member accommodating portion, of non-communicating portion is not less than 50%.

wherein there are provided a plurality of such non-transmitting portions; and wherein said non-transmitting portions are off-set such that communicating portions are not aligned in a line along the direction.

2. An ink container according to claim 1, wherein said non-transmitting portion constitutes a part of a casing of said ink container.

3. An ink container according to claim 1, wherein said non-transmitting portion is in the form of a sheet sandwiched in said negative pressure generating member.

4. An ink container according to claim 1, wherein said non-transmitting portion is constituted by a resin material film welded on a surface of said negative pressure generating member.

5. An ink container according to claim 1, wherein said non-transmitting portion is in the form of a film provided on a surface of said generating member by a thermal treatment.

6. An ink container according to claim 1, wherein said negative pressure generating member includes a plurality of blocks which are separated by said non-communicating portion.

7. An ink container according to claim 6, wherein said negative pressure generating member blocks exhibit capillary forces which are higher toward said communicating portion.

8. An ink container comprising:

a negative pressure generating member accommodating portion for accommodating a negative pressure generating member for retaining therein pigment ink to be supplied to an ink jet head;

an ink supply port for supplying the ink to said ink jet head, said ink supply port being disposed at a lower position with respect to a direction of gravity force in use of said ink container;

an air vent for fluid communication between said negative pressure generating member accommodating portion and an ambient air; and an ink blocking surface extending in a direction across the direction of the gravity force, said blocking surface is provided with a blocking portion for blocking the flow of the ink and a fluid communicating portion permitting the flow of the ink, wherein a sectional area, across the direction of the gravity force in said negative pressure generating member accommodating portion, of blocking portion is not less than 50%, wherein there are provided a plurality of such blocking surfaces, and said communicating portions thereof are not aligned in a line along the direction.

9. An ink container according to claim 8, wherein said blocking surface is provided by a part of a casing of said ink container.

10. An ink container according to claim 8, wherein said blocking surface is provided on a sheet sandwiched in said negative pressure generating member.

11. An ink container according to claim 8, wherein said blocking surface is constituted by a resin material film welded on a surface of said negative pressure generating member.

12. An ink container according to claim 8, wherein said blocking surface is in the form of a film provided on a surface of said generating member by a thermal treatment.

13. An ink container according to claim 8, wherein said negative pressure generating member includes a plurality of blocks which are separated by said blocking surface portion.

14. An ink container according to claim 13, wherein said negative pressure generating member blocks exhibit capillary forces which are higher toward said communicating portion.

* * * * *